US011713757B2

(12) United States Patent
Afshari

(10) Patent No.: US 11,713,757 B2
(45) Date of Patent: Aug. 1, 2023

(54) PUMP INTEGRATED WITH TWO INDEPENDENTLY DRIVEN PRIME MOVERS

(71) Applicant: Project Phoenix, LLC, Mesa, AZ (US)

(72) Inventor: Thomas Afshari, Phoenix, AZ (US)

(73) Assignee: PROJECT PHOENIX, LLC, Mesa, AZ (US)

( * ) Notice: Subject to any disclaimer, the term of this patent is extended or adjusted under 35 U.S.C. 154(b) by 0 days.

(21) Appl. No.: 17/411,326

(22) Filed: Aug. 25, 2021

(65) Prior Publication Data

US 2022/0220959 A1 Jul. 14, 2022

Related U.S. Application Data

(63) Continuation of application No. 15/887,856, filed on Feb. 2, 2018, now Pat. No. 11,118,581, which is a (Continued)

(51) Int. Cl.
*F04C 2/18* (2006.01)
*F04C 15/00* (2006.01)
(Continued)

(52) U.S. Cl.
CPC ..... *F04C 2/18* (2013.01); *F04C 2/08* (2013.01); *F04C 2/084* (2013.01); *F04C 2/102* (2013.01);
(Continued)

(58) Field of Classification Search
CPC .... F04C 2/08; F04C 2/18; F04C 2/084; F04C 2/102; F04C 15/008; F04C 2240/40; F04C 2240/402; F04C 2270/16
See application file for complete search history.

(56) References Cited

U.S. PATENT DOCUMENTS 337,551 A 3/1886 Berrenberg et al.
688,616 A 12/1901 Ferguson
(Continued)

FOREIGN PATENT DOCUMENTS

CA 2236535 A1 11/1999
CA 2878316 A1 3/2014
(Continued)

OTHER PUBLICATIONS

Examination Report for EP Application No. 15715589.6; 4 pages (dated Jun. 13, 2022).
(Continued)

*Primary Examiner* — Charles G Freay
(74) *Attorney, Agent, or Firm* — Perkins Coie LLP

(57) ABSTRACT

A pump having at least two fluid drivers and a method of delivering fluid from an inlet of the pump to an outlet of the pump using the at least two fluid drivers. Each of the fluid drives includes a prime mover and a fluid displacement member. The prime mover drives the fluid displacement member to transfer fluid. The fluid drivers are independently operated. However, the fluid drivers are operated such that contact between the fluid drivers is synchronized. That is, operation of the fluid drivers is synchronized such that the fluid displacement member in each fluid driver makes contact with another fluid displacement member. The contact can include at least one contact point, contact line, or contact area.

20 Claims, 10 Drawing Sheets

Related U.S. Application Data continuation of application No. 14/944,368, filed on Nov. 18, 2015, now Pat. No. 9,920,755, which is a continuation of application No. 14/637,064, filed on Mar. 3, 2015, now Pat. No. 9,228,586, which is a continuation of application No. PCT/US2015/018342, filed on Mar. 2, 2015.

(60) Provisional application No. 61/946,384, filed on Feb. 28, 2014, provisional application No. 61/946,395, filed on Feb. 28, 2014, provisional application No. 61/946,405, filed on Feb. 28, 2014, provisional application No. 61/946,422, filed on Feb. 28, 2014, provisional application No. 61/946,433, filed on Feb. 28, 2014, provisional application No. 61/946,374, filed on Feb. 28, 2014.

(51) Int. Cl.

| | |
|---|---|
| ***F04C 11/00*** | (2006.01) |
| ***F04C 2/08*** | (2006.01) |
| ***F04C 2/10*** | (2006.01) |
| *F04C 13/00* | (2006.01) |
| *F04C 2/16* | (2006.01) |

(52) U.S. Cl.

CPC ..... *F04C 11/008* (2013.01); *F04C 15/008* (2013.01); *F04C 2/16* (2013.01); *F04C 13/005* (2013.01); *F04C 2240/40* (2013.01); *F04C 2240/402* (2013.01); *F04C 2270/16* (2013.01)

(56) References Cited

U.S. PATENT DOCUMENTS

| | | | |
|---|---|---|---|
| 1,341,846 | A | 6/1920 | Gollings |
| 1,361,423 | A | 12/1920 | Waterous |
| 1,407,496 | A | 2/1922 | Storey |
| 1,418,741 | A | 6/1922 | Stallman |
| 1,665,120 | A | 4/1928 | Wendell |
| 1,681,796 | A | 8/1928 | Wendell |
| 1,712,157 | A | 5/1929 | Morita |
| 2,439,427 | A | 4/1948 | Guibert et al. |
| 2,572,334 | A | 10/1951 | Guibert |
| 2,601,397 | A | 6/1952 | Hill et al. |
| 2,621,603 | A | 12/1952 | Thomas |
| 2,918,209 | A | 12/1959 | Schueller |
| 2,927,429 | A | 3/1960 | Carlson |
| 2,928,295 | A | 3/1960 | Boulanger |
| 2,937,807 | A | 5/1960 | Lorenz |
| 2,940,661 | A | 6/1960 | Lorenz |
| 3,136,224 | A | 6/1964 | Escobosa |
| 3,264,502 | A | 8/1966 | Lytle et al. |
| 3,585,973 | A | 6/1971 | Klover |
| 3,694,105 | A | 9/1972 | Martin |
| 3,763,746 | A | 10/1973 | Walters |
| 3,922,855 | A | 12/1975 | Bridwell et al. |
| 3,932,993 | A | 1/1976 | Riedhammer |
| 3,979,910 | A | 9/1976 | Leuenberger et al. |
| 4,016,719 | A | 4/1977 | Yavnai |
| 4,030,403 | A | 6/1977 | Elser |
| 4,345,436 | A | 8/1982 | Johnson |
| 4,369,625 | A | 1/1983 | Izumi et al. |
| 4,418,610 | A | 12/1983 | Holtrop |
| 4,529,362 | A | 7/1985 | Ichiryu et al. |
| 4,627,237 | A | 12/1986 | Hutson |
| 4,630,441 | A | 12/1986 | Chamberlain |
| 4,682,939 | A | 7/1987 | Petro |
| 4,696,163 | A | 9/1987 | Glomeau |
| 4,850,812 | A | 7/1989 | Voight |
| 5,026,248 | A | 6/1991 | Hamilton |
| 5,048,294 | A | 9/1991 | Oshina et al. |
| 5,073,091 | A | 12/1991 | Burgess et al. |
| 5,161,957 | A | 11/1992 | Ribaudo |
| 5,197,861 | A | 3/1993 | Maruyama et al. |
| 5,271,719 | A | 12/1993 | Abe et al. |
| 5,295,798 | A | 3/1994 | Maruyama et al. |
| 5,329,216 | A | 7/1994 | Hasegawa |
| 5,708,311 | A | 1/1998 | Claar et al. |
| 5,709,537 | A | 1/1998 | Maruyama et al. |
| 5,767,635 | A | 6/1998 | Steffens et al. |
| 5,767,638 | A | 6/1998 | Wu et al. |
| 5,778,671 | A | 7/1998 | Bloomquist et al. |
| 5,836,746 | A | 11/1998 | Maruyama et al. |
| 6,002,186 | A | 12/1999 | Coutu et al. |
| 6,004,119 | A | 12/1999 | Yoshiaki et al. |
| 6,042,095 | A | 3/2000 | Kuchta |
| 6,048,235 | A | 4/2000 | Kai |
| 6,053,717 | A | 4/2000 | Dixon |
| 6,155,790 | A | 12/2000 | Pyötsia et al. |
| 6,247,906 | B1 | 6/2001 | Pijanowski |
| 6,447,256 | B2 | 9/2002 | Bussard |
| 6,447,266 | B2 | 9/2002 | Antaki et al. |
| 6,543,223 | B2 | 4/2003 | Muschong et al. |
| 6,652,249 | B2 | 11/2003 | Kenney et al. |
| 6,796,120 | B2 | 9/2004 | Franchet et al. |
| 6,971,463 | B2 | 12/2005 | Shore et al. |
| 6,979,185 | B2 | 12/2005 | Kaempe |
| 7,000,386 | B1 | 2/2006 | Morgan |
| 7,051,526 | B2 | 5/2006 | Geiger |
| 7,155,910 | B2 | 1/2007 | Last |
| 7,191,593 | B1 | 3/2007 | Ho |
| 7,232,292 | B2 | 6/2007 | Lopatinsky et al. |
| 7,240,893 | B2 | 6/2007 | Komaba et al. |
| 7,281,372 | B2 | 10/2007 | Sakai et al. |
| 7,434,395 | B2 | 10/2008 | He |
| 7,537,441 | B2 | 5/2009 | Iwasaki |
| 7,870,727 | B2 | 1/2011 | Mueller et al. |
| 7,927,079 | B2 | 4/2011 | Suzuki et al. |
| 8,157,539 | B2 | 4/2012 | Hidaka et al. |
| 8,167,589 | B2 | 5/2012 | Hidaka et al. |
| 8,206,134 | B2 | 6/2012 | Moldovan et al. |
| 8,448,432 | B2 | 5/2013 | Bresie |
| 8,869,924 | B2 | 10/2014 | Kim |
| 8,959,905 | B2 | 2/2015 | Baltes et al. |
| 9,228,586 | B2 * | 1/2016 | Afshari ..... F04C 2/18 |
| 9,234,532 | B2 | 1/2016 | Vanderlaan et al. |
| 9,670,943 | B2 | 6/2017 | Gomm et al. |
| 9,920,755 | B2 * | 3/2018 | Afshari ..... F04C 15/008 |
| 10,072,676 | B2 | 9/2018 | Afshari |
| 11,118,581 | B2 * | 9/2021 | Afshari ..... F04C 2/18 |
| 2002/0009368 | A1 | 1/2002 | Bussard |
| 2003/0077183 | A1 | 4/2003 | Franchet et al. |
| 2003/0091448 | A1 | 5/2003 | Prampolini |
| 2003/0126981 | A1 | 7/2003 | Bridger et al. |
| 2003/0151315 | A1 | 8/2003 | Choi et al. |
| 2004/0060430 | A1 | 4/2004 | Brinkman |
| 2004/0213680 | A1 | 10/2004 | Suzuki et al. |
| 2005/0022523 | A1 | 2/2005 | Nagai et al. |
| 2005/0089414 | A1 | 4/2005 | Ohman |
| 2005/0112012 | A1 | 5/2005 | Marheineie |
| 2005/0144939 | A1 | 7/2005 | Mentink et al. |
| 2005/0254970 | A1 | 11/2005 | Mayer et al. |
| 2006/0001202 | A1 | 1/2006 | Bauman |
| 2006/0039804 | A1 | 2/2006 | Jordan et al. |
| 2006/0156713 | A1 | 7/2006 | Kadlicko |
| 2007/0074511 | A1 | 4/2007 | Verkuilen |
| 2007/0098576 | A1 | 5/2007 | Horng et al. |
| 2007/0101711 | A1 | 5/2007 | Debus |
| 2007/0157612 | A1 | 7/2007 | He |
| 2007/0166168 | A1 | 7/2007 | Vigholm |
| 2008/0010984 | A1 | 1/2008 | Arbel et al. |
| 2008/0190104 | A1 | 8/2008 | Bresie |
| 2009/0210120 | A1 | 8/2009 | Stein |
| 2009/0266934 | A1 | 10/2009 | Makino |
| 2009/0297370 | A1 | 12/2009 | Moldovan et al. |
| 2010/0226806 | A1 | 9/2010 | Mellet et al. |
| 2010/0247362 | A1 | 9/2010 | Koizumi |
| 2010/0264885 | A1 | 10/2010 | Olsen et al. |
| 2010/0322805 | A1 | 12/2010 | Aregger |
| 2011/0000203 | A1 | 1/2011 | Riedel et al. |
| 2011/0017310 | A1 | 1/2011 | Eriksson |
| 2011/0030364 | A1 | 2/2011 | Persson et al. |
| 2011/0030505 | A1 | 2/2011 | Hoyle et al. |

(56) References Cited

U.S. PATENT DOCUMENTS

| | | | |
|---|---|---|---|
| 2011/0089082 | A1 | 4/2011 | Snawerdt |
| 2011/0135516 | A1 | 6/2011 | Oishi et al. |
| 2011/0209471 | A1 | 9/2011 | Vanderlaan et al. |
| 2011/0250082 | A1 | 10/2011 | Han et al. |
| 2012/0141315 | A1 | 6/2012 | Seto et al. |
| 2012/0173027 | A1 | 7/2012 | Cheng et al. |
| 2012/0213657 | A1 | 8/2012 | Kimberlin et al. |
| 2012/0217117 | A1 | 8/2012 | Gramann et al. |
| 2012/0233997 | A1 | 9/2012 | Andruch, III et al. |
| 2012/0260641 | A1 | 10/2012 | Opdenboch |
| 2012/0260642 | A1 | 10/2012 | Opdenboch |
| 2012/0305603 | A1 | 12/2012 | Kwok et al. |
| 2013/0074487 | A1 | 3/2013 | Herold et al. |
| 2013/0091833 | A1 | 4/2013 | Zhan et al. |
| 2013/0098015 | A1 | 4/2013 | Opdenbosh |
| 2013/0098017 | A1 | 4/2013 | Knussman et al. |
| 2013/0098464 | A1 | 4/2013 | Knussman |
| 2013/0239558 | A1 | 9/2013 | Shirao |
| 2013/0298542 | A1 | 11/2013 | Lowman et al. |
| 2014/0105714 | A1 | 4/2014 | Kim |
| 2014/0130487 | A1 | 5/2014 | Akiyama et al. |
| 2014/0174549 | A1 | 6/2014 | Dybing |
| 2014/0260233 | A1 | 9/2014 | Giovanardi |
| 2014/0308106 | A1 | 10/2014 | Beschorner |
| 2014/0366519 | A1 | 12/2014 | Sadamori |
| 2015/0121860 | A1 | 5/2015 | Hyon |
| 2015/0275927 | A1 | 10/2015 | Gomm et al. |
| 2015/0308463 | A1 | 10/2015 | Gomm et al. |
| 2015/0361743 | A1 | 12/2015 | Mikkulainen |
| 2016/0102685 | A1 | 4/2016 | Chester |

FOREIGN PATENT DOCUMENTS

| | | | |
|---|---|---|---|
| CH | 625600 | A5 | 9/1981 |
| CN | 202165337 | U | 3/2012 |
| CN | 104454803 | A | 3/2015 |
| CN | 101655087 | A | 2/2018 |
| CN | 109779985 | A | 5/2019 |
| DE | 1258617 | | 1/1968 |
| DE | 1528965 | | 10/1969 |
| DE | 3230550 | A1 | 1/1984 |
| DE | 3247004 | A1 | 6/1984 |
| DE | 3821321 | A1 | 12/1989 |
| DE | 102008018407 | A1 | 10/2009 |
| DE | 102009027282 | A1 | 12/2010 |
| DE | 102009028095 | A1 | 2/2011 |
| DE | 102009045028 | A1 | 3/2011 |
| DE | 102011005831 | A1 | 9/2012 |
| DE | 102012102156 | A1 | 10/2012 |
| DE | 102011076127 | A1 | 11/2012 |
| EP | 0558921 | A1 | 9/1993 |
| EP | 0942173 | A1 | 9/1999 |
| EP | 1249608 | A1 | 10/2002 |
| EP | 1531269 | A1 | 5/2005 |
| EP | 1967745 | A1 | 9/2008 |
| EP | 2113666 | A2 | 11/2009 |
| EP | 2767720 | A1 | 8/2014 |
| EP | 2816237 | A1 | 12/2014 |
| FR | 2119294 | A5 | 8/1972 |
| FR | 2428771 | A1 | 1/1980 |
| GB | 270000 | A | 5/1927 |
| GB | 1081711 | A | 8/1967 |
| GB | 1284551 | A | 8/1972 |
| GB | 1284552 | A | 8/1972 |
| GB | 1284553 | A | 8/1972 |
| GB | 1450436 | A | 9/1976 |
| GB | 2123089 | A | 1/1984 |
| GB | 2259333 | A | 3/1993 |
| JP | S5920590 | A | 2/1984 |
| JP | H11166496 | A | 6/1999 |
| JP | H11336671 | A | 12/1999 |
| JP | 2001011899 | A | 1/2001 |
| JP | 2001153066 | A | 6/2001 |
| JP | 2002147370 | A | 6/2002 |
| JP | 2003088084 | A | 3/2003 |
| JP | 2003106304 | A | 4/2003 |
| JP | 2006316662 | A | 11/2006 |
| JP | 3154210 | U | 10/2009 |
| JP | 2010038316 | A | 2/2010 |
| JP | 2014009655 | A | 1/2014 |
| JP | 2014512495 | A | 5/2014 |
| RU | 2284424 | C1 | 9/2006 |
| RU | 2009149035 | A | 8/2011 |
| SU | 857550 | A1 | 8/1981 |
| SU | 1087705 | A1 | 4/1984 |
| WO | WO9113256 | A1 | 9/1991 |
| WO | WO01073295 | A1 | 10/2001 |
| WO | WO03069160 | A1 | 8/2003 |
| WO | WO2004071845 | A1 | 8/2004 |
| WO | WO2008060681 | A2 | 5/2008 |
| WO | WO2010083991 | A2 | 7/2010 |
| WO | WO2010097596 | A1 | 9/2010 |
| WO | WO2011035971 | A2 | 3/2011 |
| WO | WO2011048261 | A1 | 4/2011 |
| WO | WO2011072502 | A1 | 6/2011 |
| WO | WO2012122159 | A2 | 9/2012 |
| WO | WO2013006902 | A1 | 1/2013 |
| WO | WO2013027620 | A1 | 2/2013 |
| WO | WO2014060760 | A2 | 4/2014 |
| WO | WO2014074713 | A1 | 5/2014 |
| WO | WO2014135284 | A1 | 9/2014 |
| WO | WO2014176256 | A1 | 10/2014 |
| WO | WO2017040825 | A1 | 3/2017 |
| WO | WO2018206050 | A1 | 11/2018 |

OTHER PUBLICATIONS

Extended European Search Report, EP Application No. 22162029.7; 8 pages (dated Jul. 5, 2022).

Examination Report for EP Application No. 15784832.6, 7 pages (dated Jul. 5, 2022).

U.S. Appl. No. 16/787,876, filed Feb. 11, 2020, now U.S. Pat. No. 10,995,750, titled External Gear Pump Integrated With Two Independently Driven Prime Movers.

U.S. Appl. No. 17/022,059, filed Sep. 15, 2020, titled System to Pump Fluid and Control Thereof.

U.S. Appl. No. 17/243,483, filed Apr. 28, 2021, titled System to Pump Fluid and Control Thereof.

U.S. Appl. No. 17/555,978, filed Dec. 20, 2021, titled Linear Actuator Assembly and System.

U.S. Appl. No. 17/364,305, filed Jun. 30, 2021, now abandoned, titled Hydrostatic Transmission Assembly and System.

U.S. Appl. No. 17/364,372, filed Jun. 30, 2021, now abandoned, titled Hydrostatic Transmission Assembly and System.

U.S. Appl. No. 17/555,978, filed Dec. 20, 2020, titled Linear Actuator Assembly and System.

Esposito, Fluid Power with Applicators, 7th Ed., Chapter 5, pp. 154-162 (2009).

Marks' Standard Handbook for Mechanical Engineers, Eighth Ed., Section 14, pp. 14-1-14-31 (1978).

Yusof et al., "Slip flow coefficient analysis in water hydraulics gear pump for environmental friendly application," IOP Conf. Series: Materials Science and Engineering, 50:012016 (2013).

International Search Report and Written Opinion, International Application No. PCT/US2015/018342 (published as WO 2015/131196), 19 pages (dated Jul. 20, 2015).

International Search Report and Written Opinion, International Application No. PCT/US2015/022484, (published as WO 2015/148662), 9 pages (dated Jun. 9, 2015).

International Search Report and Written Opinion, International Application No. PCT/US2015/027003 (published as WO 2015/164453), 18 pages (dated Nov. 4, 2015).

International Search Report and Written Opinion, International Application No. PCT/US2015/033752 (published as WO 2015/187673), 15 pages (dated Sep. 29, 2015).

International Search Report and Written Opinion, International Application No. PCT/US2015/033764 (published as WO 2015/187681), 7 pages (dated Aug. 19, 2015).

(56) References Cited

OTHER PUBLICATIONS

International Search Report and Written Opinion, International Application No. PCT/US2015/033776 (published as WO 2015/187688), 31 pages (dated Oct. 28, 2015).
International Search Report and Written Opinion, International Application No. PCT/US2015/041612 (published as WO 2016/014715), 8 pages (dated Sep. 28, 2015).
International Search Report and Written Opinion, International Application No. PCT/US2015/053670 (published as WO 2015/057321), 10 pages (dated Dec. 16, 2015).
International Search Report and Written Opinion, International Application No. PCT/US2015/054145 (published as WO 2016/064569), 9 pages (dated Feb. 2, 2016).
International Search Report and Written Opinion, International Application No. PCT/US2015/050589 (published as WO 2016/048773), 10 pages (dated Dec. 7, 2015).
International Search Report and Written Opinion, International Application No. PCT/US2016/049918 (published as WO 2017/040792), 10 pages (dated Nov. 23, 2016).
International Search Report and Written Opinion, International Application No. PCT/US2016/049959 (published as WO 2017/040825), 10 pages (dated Dec. 9, 2016).
International Search Report and Written Opinion, International Application No. PCT/US2021/040686, (dated Oct. 10, 2021), 13 pages.
International Search Report and Written Opinion of International Application No. PCT/US2021/040701, (dated Oct. 27, 2021) 12 pages.
Supplementary European Search Report, EP Application No. 15803994.1, 7 pages (dated Jan. 22, 2018).
Supplementary European Search Report, EP Application No. 15802457.0, 24 pages (dated Mar. 14, 2018).
Supplemental European Search Report, EP Application No. 18207568.9, 7 pages (dated Feb. 4, 2019).
Supplementary European Search Report, EP Application No. 20166746.6, 7 pages (dated May 6, 2020).
Supplementary European Search Report, EP Application No. 20168937.9, 8 pages (dated May 14, 2020).
Supplementary European Search Report, EP Application No. 20179980.6, 8 pages (dated Jul. 30, 2020).
Extended European Search Report, EP Application No. 20197360.9, 8 pages (dated Nov. 10, 2020).
Extended European Search Report, EP Application No. 201168887.4, 10 pages (dated May 21, 2021).
Examination Report for EP Application No. 20179980.6; 4 pages (dated May 26, 2021).
Examination European Search Report, EP Application No. 157219434.7; 4 pages (dated Aug. 30, 2021).
Extended European Search Report, EP Application No. 21175762.0; 7 pages (dated Sep. 17, 2021).
Extended European Search Report, EP Applciation No. 21201681.0; 8 pages (dated Jan. 24, 2022).
Extended European Search Report, EP Application No. 21203155.3; 8 pages (dated Feb. 23, 2022).
U.S. Appl. No. 14/637,064, filed Mar. 3, 2015, now U.S. Pat. No. 9,228,586, titled Pump Integrated With Two Independently Driven Prime Movers.
U.S. Appl. No. 14/862,608, filed Sep. 23, 2015, now U.S. Pat. No. 10,072,676, titled System to Pump Fluid and Control Thereof.
U.S. Appl. No. 14/944,368, filed Nov. 18, 2015, now U.S. Pat. No. 9,920,755, titled Pump Integrated With Two Independently Driven Prime Movers.
U.S. Appl. No. 15/128,269, filed Sep. 22, 2016, now U.S. Pat. No. 10,465,721, titled System to Pump Fluid and Control Thereof.
U.S. Appl. No. 15/305,579, filed Apr. 22, 2015, now U.S. Pat. No. 10,294,936, titled Fluid Delivery System With a Shaft Having a Through-Passage.
U.S. Appl. No. 15/315,560, filed Jun. 2, 2015, now U.S. Pat. No. 10,544,861, titled Hydrostatic Transmission Assembly and System.
U.S. Appl. No. 15/315,575, filed Jun. 2, 2015, now U.S. Pat. No. 10,544,810, titled Linear Actuator Assembly and System.
U.S. Appl. No. 15/315,592, filed Jun. 2, 2015, now U.S. Pat. No. 10,738,799, titled Linear Actuator Assembly and System.
U.S. Appl. No. 15/327,748, filed Jul. 22, 2015, now U.S. Pat. No. 10,598,176, titled External Gear Pump Integrated With Two Independently Driven Prime Movers.
U.S. Appl. No. 15/517,356, filed Oct. 2, 2015, now U.S. Pat. No. 10,598,176, titled Linear Actuator Assembly and System.
U.S. Appl. No. 15/520,386, filed Oct. 6, 2015, now U.S. Pat. No. 10,677,352, titled Hydrostatic Transmission Assembly and System.
U.S. Appl. No. 15/756,928, filed Mar. 1, 2018, now U.S. Pat. No. 11,085,440, titled System to Pump Fluid and Control Thereof.
U.S. Appl. No. 15/756,942, filed Sep. 1, 2016, now U.S. Pat. No. 10,865,788, titled System to Pump Fluid and Control Thereof.
U.S. Appl. No. 15/887,856, filed Feb. 2, 2018, now U.S. Pat. No. 11,060,534, titled Pump Integrated With Two Independently Drive Prime Movers.
U.S. Appl. No. 16/118,167, filed Aug. 30, 2018, now U.S. Pat. No. 10,808,732, titled System to Pump Fluid and Control Thereof.
U.S. Appl. No. 16/374,456, filed Apr. 3, 2019, now U.S. Pat. No. 11,280,334, titled Fluid Delivery System With a Shaft Having a Through-Passage.
U.S. Appl. No. 16/698,566, filed Nov. 27, 2019, now U.S. Pat. No. 11,054,026, titled Hydrostatic Transmission Assembly and System.
U.S. Appl. No. 16/698,631, filed Nov. 27, 2019, now U.S. Pat. No. 11,242,851, titled Linear Actuator Assembly and System.
U.S. Appl. No. 16/714,504, filed Dec. 13, 2019, now U.S. Pat. No. 11,060,634, titled Linear Actuator Assembly and System.
U.S. Appl. No. 16/714,540, filed Dec. 13, 2019, now U.S. Pat. No. 11,067,170, titled Hydrostatic Transmission Assembly and System.
U.S. Appl. No. 16/787,876, filed Feb. 11, 2020, now U.S. Pat. No. 10,995,750, titled External Gear Pump Integrated With Two Independently Drive Prime Movers.
U.S. Appl. No. 16/936,366, filed Jul. 22, 2020, titled Linear Actuator Assembly and System.
U.S. Appl. No. 17/022,059, now U.S. Pat. No. 11,408,442, filed Sep. 15, 2020, titled System to Pump Fluid and Control Thereof.
U.S. Appl. No. 17/092,159, filed Nov. 6, 2020, titled System to Pump Fluid and Control Thereof.
U.S. Appl. No. 17/243,483, filed Apr. 28, 2021, now U.S. Pat. No. 11,512,695, titled System to Pump Fluid and Control Thereof.
U.S. Appl. No. 17/358,410, filed Jun. 25, 2021, titled System to Pump Fluid and Control Thereof.
U.S. Appl. No. 17/364,097, filed Jun. 30, 2021, titled Linear Actuator Assembly and System.
U.S. Appl. No. 17/555,978, filed Dec. 20, 2021, titled Linear Actuator Assembly and System, now abandoned.
U.S. Appl. No. 17/842,453, filed Jun. 16, 2022, titled System to Pump Fluid and Control Thereof.
U.S. Appl. No. 18/004,539, filed Jan. 6, 2023, titled Dynamic Control of Gears in a Gear Pump Having a Drive-Drive Configuration.
U.S. Appl. No. 18/004,610, filed Jan. 6, 2023, titled Dynamic Control of Gears in a Gear Pump Having a Drive-Drive Configuration.
Brazil Office Action in Brazilian Application No. BR112016019769-0; 5 pages (dated May 11, 2020).
Canadian Office Action in Canadian Application No. 2,940,679; 4 pages (dated Apr. 22, 2021).
Examination Report, EP Application No. 15709812.0, 5 pages (dated Jun. 17, 2019).
Examination Report for EP Application No. 20197360.9, 8 pages (dated Nov. 28, 2022).
Extended European Search Report for EP Application No. 22202305.3; 7 pages (dated Jan. 25, 2023).
Examination Report for India Application No. 201647032718; 8 pages (dated Nov. 27, 2019).
Examination Report for India Application No. 202048019262; 6 pages (dated Dec. 30, 2021).
Office Action in Israel Application No. 285741; 3 pages (dated Feb. 13, 2022).
Office Action in Japanese Application No. 2016-554645; 10 pages (dated Nov. 6, 2019).

(56) References Cited

OTHER PUBLICATIONS

Decision of Rejection in Japanese Application No. 2016-554645; 11 pages (dated Jun. 30, 2020).
Examiner's Report of Reconsideration in Japanese Application No. 2016-554645; 8 pages (dated Dec. 11, 2020).
Office Action in Japanese Application No. 2016-554645; 8 pages (dated Jul. 1, 2021).
Office Action in Japanese Application No. 2020-183814; 10 pages (dated Oct. 22, 2021).
Office Action in Japanese Application No. 2016-554645; 7 pages (dated Mar. 31, 2022).
Office Action in Japanese Application No. 2020-183814; 3 pages (dated Aug. 12, 2022).
Office Action in Mexican Application No. MX/a/2016/011024; 4 pages (dated Jan. 23, 2020).
Second Office Action in Mexican Application No. MX/a/2016/011024; 8 pages (dated Jul. 21, 2020).
Third Office Action in Mexican Application No. MX/a/2016/011024; 10 pages (dated Nov. 11, 2020).
Office Action in Russian Application No. 2016138361; 10 pages (dated Oct. 22, 2018).
Second Office Action in Russian Application No. 2016138361; 15 pages (dated Feb. 28, 2019).
First Examination Report in Saudi Arabia Application No. 516371754; 14 pages (dated Mar. 27, 2020).
Second Examination Report in Saudi Arabia Application No. 516371754; 7 pages (dated Jun. 13, 2021).
Examination Report for Vietnam Application No. 1-2016-03619; 3 pages (dated Oct. 5, 2020).
Examination Report Search Report for EP Application No. 21151341.1; 5 pages (dated Mar. 10, 2023).

* cited by examiner

PUMP INTEGRATED WITH TWO INDEPENDENTLY DRIVEN PRIME MOVERS

PRIORITY

The present application is a continuation of U.S. patent application Ser. No. 15/887,856 filed on Feb. 2, 2018, which is a continuation of U.S. patent application Ser. No. 14/944,368 filed on Nov. 18, 2015, now U.S. Pat. No. 9,920,755, which is a continuation of U.S. patent application Ser. No. 14/637,064 filed on Mar. 3, 2015, now U.S. Pat. No. 9,228,586, which is a continuation of International Application No. PCT/US2015/018342 filed on Mar. 2, 2015, which claims priority to U.S. Provisional Patent Application Nos. 61/946,374; 61/946,384; 61/946,395; 61/946,405; 61/946,422; and 61/946,433 filed on Feb. 28, 2014, each of which application is incorporated herein by reference in its entirety.

TECHNICAL FIELD

The present invention relates generally to pumps and pumping methodologies thereof, and more particularly to pumps using two fluid drivers each integrated with an independently driven prime mover.

BACKGROUND OF THE INVENTION

Pumps that pump a fluid can come in a variety of configurations. For example, gear pumps are positive displacement pumps (or fixed displacement), i.e. they pump a constant amount of fluid per each rotation and they are particularly suited for pumping high viscosity fluids such as crude oil. Gear pumps typically comprise a casing (or housing) having a cavity in which a pair of gears are arranged, one of which is known as a drive gear, which is driven by a driveshaft attached to an external driver such as an engine or an electric motor, and the other of which is known as a driven gear (or idler gear), which meshes with the drive gear. Gear pumps, in which one gear is externally toothed and the other gear is internally toothed, are referred to as internal gear pumps. Either the internally or externally toothed gear is the drive or driven gear. Typically, the axes of rotation of the gears in the internal gear pump are offset and the externally toothed gear is of smaller diameter than the internally toothed gear. Alternatively, gear pumps, in which both gears are externally toothed, are referred to as external gear pumps. External gear pumps typically use spur, helical, or herringbone gears, depending on the intended application. Related art external gear pumps are equipped with one drive gear and one driven gear. When the drive gear attached to a rotor is rotatably driven by an engine or an electric motor, the drive gear meshes with and turns the driven gear. This rotary motion of the drive and driven gears carries fluid from the inlet of the pump to the outlet of the pump. In the above related art pumps, the fluid driver consists of the engine or electric motor and the pair of gears.

However, as gear teeth of the fluid drivers interlock with each other in order for the drive gear to turn the driven gear, the gear teeth grind against each other and contamination problems can arise in the system, whether it is in an open or closed fluid system, due to sheared materials from the grinding gears and/or contamination from other sources. These sheared materials are known to be detrimental to the functionality of the system, e.g., a hydraulic system, in which the gear pump operates. Sheared materials can be dispersed in the fluid, travel through the system, and damage crucial operative components, such as O-rings and bearings. It is believed that a majority of pumps fail due to contamination issues, e.g., in hydraulic systems. If the drive gear or the drive shaft fails due to a contamination issue, the whole system, e.g., the entire hydraulic system, could fail. Thus, known driver-driven gear pump configurations, which function to pump fluid as discussed above, have undesirable drawbacks due to the contamination problems.

Further limitation and disadvantages of conventional, traditional, and proposed approaches will become apparent to one skilled in the art, through comparison of such approaches with embodiments of the present invention as set forth in the remainder of the present disclosure with reference to the drawings.

SUMMARY OF THE INVENTION

Exemplary embodiments of the invention are directed to a pump having at least two fluid drivers and a method of delivering fluid from an inlet of the pump to an outlet of the pump using the at least two fluid drivers. Each of the fluid drives includes a prime mover and a fluid displacement member. The prime mover drives the fluid displacement member and can be, e.g., an electric motor, a hydraulic motor or other fluid-driven motor, an internal-combustion, gas or other type of engine, or other similar device that can drive a fluid displacement member. The fluid displacement members transfer fluid when driven by the prime movers. The fluid displacement members are independently driven and thus have a drive-drive configuration. The drive-drive configuration eliminates or reduces the contamination problems of known driver-driven configurations.

The fluid displacement member can work in combination with a fixed element, e.g., pump wall, crescent, or other similar component, and/or a moving element such as, e.g., another fluid displacement member when transferring the fluid. The fluid displacement member can be, e.g., an internal or external gear with gear teeth, a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven. The configuration of the fluid drivers in the pump need not be identical. For example, one fluid driver can be configured as an external gear-type fluid driver and another fluid driver can be configured as an internal gear-type fluid driver. The fluid drivers are independently operated, e.g., an electric motor, a hydraulic motor or other fluid-driven motor, an internal-combustion, gas or other type of engine, or other similar device that can independently operate its fluid displacement member. However, the fluid drivers are operated such that contact between the fluid drivers is synchronized, e.g., in order to pump the fluid and/or seal a reverse flow path. That is, operation of the fluid drivers is synchronized such that the fluid displacement member in each fluid driver makes contact with another fluid displacement member. The contact can include at least one contact point, contact line, or contact area.

In some exemplary embodiments of the fluid driver, the fluid driver can include motor with a stator and rotor. The stator can be fixedly attached to a support shaft and the rotor can surround the stator. The fluid driver can also include a gear having a plurality of gear teeth projecting radially outwardly from the rotor and supported by the rotor. In some embodiments, a support member can be disposed between the rotor and the gear to support the gear.

In exemplary embodiments, pumps and methods of pumping provide for a compact design of a pump. In an exemplary embodiment, a pump includes a pair of fluid drivers. In each of the pair of fluid drivers, a fluid displacing member is integrated with a prime mover. Each of the pair of fluid drivers is rotatably driven independently with respect to the other. In some exemplary embodiments, e.g., external gear-type pumps, the fluid displacing members of the fluid drivers are rotated in opposite directions. In other exemplary embodiments, e.g., internal gear-type pumps, the fluid displacing members of the fluid drivers are rotated in the same direction. In either rotation scheme, the rotations are synchronized to provide contact between the fluid drivers. In some embodiments, synchronizing contact includes rotatably driving one of the pair of fluid drivers at a greater rate than the other so that a surface of one fluid driver contacts a surface of another fluid driver.

In another exemplary embodiment, a pump includes a casing defining an interior volume. The casing includes a first port in fluid communication with the interior volume and a second port in fluid communication with the interior volume. A first fluid displacing member of a first fluid driver is disposed within the interior volume. A second fluid displacing member of a second fluid driver is also disposed within the interior volume. The second fluid displacing member is disposed such that the second fluid displacement member contacts the first displacement member. A first motor rotates the first fluid displacement member in a first direction to transfer the fluid from the first port to the second port along a first flow path. A second motor rotates the second fluid displacement member, independently of the first motor, in a second direction to transfer the fluid from the first port to the second port along a second flow path. The contact between the first displacement member and the second displacement member is synchronized by synchronizing the rotation of the first and second motors. In some embodiments the first motor and second motor are rotated at different revolutions per minute (rpm). In some embodiments, the synchronized contact seals a reverse flow path (or a backflow path) between the outlet and inlet of the pump. In some embodiments, the synchronized contact can be between a surface of at least one projection (bump, extension, bulge, protrusion, another similar structure or combinations thereof) on the first fluid displacement member and a surface of at least one projection (bump, extension, bulge, protrusion, another similar structure or combinations thereof) or an indent (cavity, depression, void or another similar structure) on the second fluid displacement member. In some embodiments, the synchronized contact aids in pumping fluid from the inlet to the outlet of the pump. In some embodiments, the synchronized contact both seals a reverse flow path (or backflow path) and aids in pumping the fluid. In some embodiments, the first direction and the second direction are the same. In other embodiments, the first direction is opposite the second direction. In some embodiments, at least a portion of the first flow path and the second flow path are the same. In other embodiments, at least a portion of the first flow path and the second flow path are different.

In another exemplary embodiment, a pump includes a casing defining an interior volume, the casing including a first port in fluid communication with the interior volume, and a second port in fluid communication with the interior volume. The pump also includes a first fluid driver with the first fluid driver including a first fluid displacement member disposed within the interior volume and having a plurality of first projections (or at least one first projection), and a first prime mover to rotate the first fluid displacement member about a first axial centerline of the first fluid displacement member in a first direction to transfer a fluid from the first port to the second port along a first flow path. In some embodiments the first fluid displacement member includes a plurality of first indents (or at least one first indent). The pump also includes a second fluid driver with the second fluid driver including a second fluid displacement member disposed within the interior volume. The second fluid displacement member has at least one of a plurality of second projections (or at least one second projection) and a plurality of second indents (or at least one second indent), the second gear is disposed such that a first surface of at least one of the plurality of first projections (or the at least one first projection) aligns with a second surface of at least one of the plurality of second projections (or the at least one second projection) or a third surface of at least one of the plurality of second indents (or the at least one second indent). The pump also includes a second prime mover to rotate the second fluid displacement member, independently of the first prime mover, about a second axial centerline of the second gear in a second direction to contact the first surface with the corresponding second surface or third surface and to transfer the fluid from the first port to the second port along a second flow path.

In another exemplary embodiment, a pump includes a casing defining an interior volume. The casing includes a first port in fluid communication with the interior volume and a second port in fluid communication with the interior volume. A first gear is disposed within the interior volume with the first gear having a plurality of first gear teeth. A second gear is also disposed within the interior volume with the second gear having a plurality of second gear teeth. The second gear is disposed such that a surface of at least one tooth of the plurality of second gear teeth contacts with a surface of at least one tooth of the plurality of first gear teeth. A first motor rotates the first gear about a first axial centerline of the first gear. The first gear is rotated in a first direction to transfer the fluid from the first port to the second port along a first flow path. A second motor rotates the second gear, independently of the first motor, about a second axial centerline of the second gear in a second direction to transfer the fluid from the first port to the second port along a second flow path. The contact between the surface of at least one tooth of the plurality of first gear teeth and the surface of at least one tooth of the plurality of second gear teeth is synchronized by synchronizing the rotation of the first and second motors. In some embodiments the first motor and second motor are rotated at different rpms. In some embodiments, the second direction is opposite the first direction and the synchronized contact seals a reverse flow path between the inlet and outlet of the pump. In some embodiments, the second direction is the same as the first direction and the synchronized contact at least one of seals a reverse flow path between the inlet and outlet of the pump and aids in pumping the fluid.

Another exemplary embodiment is directed to a method of delivering fluid from an inlet to an outlet of a pump having a casing to define an interior volume therein, and a first fluid driver and a second fluid driver. The method includes rotatably driving the first fluid driver in a first direction and simultaneously rotatably driving the second fluid driver independently of the first fluid driver in a second direction. In some embodiments, the method also includes synchronizing contact between the first fluid driver and the second fluid driver.

Another exemplary embodiment is directed to a method of delivering fluid from an inlet to an outlet of a pump having a casing to define an interior volume therein, and a first fluid displacement member and a second fluid displacement member. The method includes rotating the first fluid displacement member and rotating the second fluid displacement member. The method also includes synchronizing contact between the first fluid displacement member and the second fluid displacement member. In some embodiments, the first and second fluid displacement members are rotated in the same direction and in other embodiments, the first and second fluid displacement members are rotated in opposite directions.

Another exemplary embodiment is directed to a method of transferring fluid from a first port to a second port of a pump including a pump casing that defines an interior volume therein, the pump further including a first prime mover, a second prime mover, a first fluid displacement member having a plurality of first projections (or at least one first projection), and a second fluid displacement member having at least one of a plurality of second projections (or at least one second projection) and a plurality of second indents (or at least one second indent). In some embodiments the first fluid displacement member can have a plurality of first indents (or at least one first indent). The method includes rotating the first prime mover to rotate the first fluid displacement member in a first direction to transfer a fluid from the first port to the second port along a first flow path and rotating the second prime mover, independently of the first prime mover, to rotate the second fluid displacement member in a second direction to transfer the fluid from the first port to the second port along a second flow path. The method also includes synchronizing a speed of the second fluid displacement member to be in a range of 99 percent to 100 percent of a speed of the first fluid displacement member and synchronizing contact between the first displacement member and the second displacement member such that a surface of at least one of the plurality of first projections (or at least one first projection) contacts a surface of at least one of the plurality of second projections (or at least one second projection) or a surface of at least one of the plurality of indents (or at least one second indent). In some embodiments, the second direction is opposite the first direction and the synchronized contact seals a reverse flow path between the inlet and outlet of the pump. In some embodiments, the second direction is the same as the first direction and the synchronized contact at least one of seals a reverse flow path between the inlet and outlet of the pump and aids in pumping the fluid.

Another exemplary embodiment is directed to a method of transferring fluid from a first port to a second port of a pump that includes a pump casing, which defines an interior volume. The pump further includes a first motor, a second motor, a first gear having a plurality of first gear teeth, and a second gear having a plurality of second gear teeth. The method includes rotating the first motor to rotate the first gear about a first axial centerline of the first gear in a first direction. The rotation of the first gear transfers the fluid from the first port to the second port along a first flow path. The method also includes rotating the second motor, independently of the first motor, to rotate the second gear about a second axial centerline of the second gear in a second direction. The rotation of the second gear transfers the fluid from the first port to the second port along a second flow path. In some embodiments, the method further includes synchronizing contact between a surface of at least one tooth of the plurality of second gear teeth and a surface of at least one tooth of the plurality of first gear teeth. In some embodiments, the synchronizing the contact includes rotating the first and second motors at different rpms. In some embodiments, the second direction is opposite the first direction and the synchronized contact seals a reverse flow path between the inlet and outlet of the pump. In some embodiments, the second direction is the same as the first direction and the synchronized contact at least one of seals a reverse flow path between the inlet and outlet of the pump and aids in pumping the fluid.

The summary of the invention is provided as a general introduction to some embodiments of the invention, and is not intended to be limiting to any particular drive-drive configuration or drive-drive-type system. It is to be understood that various features and configurations of features described in the Summary can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF EXEMPLARY EMBODIMENTS

Exemplary embodiments of the present invention are directed to a pump with independently driven fluid drivers. As discussed in further detail below various exemplary embodiments include pump configurations in which at least one prime mover is disposed internal to a fluid displacement member. In other exemplary embodiments, at least one prime mover is disposed external to a fluid displacement member but still inside the pump casing, and in still further exemplary embodiments, at least one prime mover is disposed outside the pump casing. These exemplary embodiments will be described using embodiments in which the pump is an external gear pump with two prime movers, the prime movers are motors and the fluid displacement members are external spur gears with gear teeth. However, those skilled in the art will readily recognize that the concepts, functions, and features described below with respect to motor driven external gear pump with two fluid drivers can be readily adapted to external gear pumps with other gear designs (helical gears, herringbone gears, or other gear teeth designs that can be adapted to drive fluid), internal gear pumps with various gear designs, to pumps with more than two fluid drivers, to prime movers other than electric motors, e.g., hydraulic motors or other fluid-driven motors, internal-combustion, gas or other type of engines or other similar devices that can drive a fluid displacement member, and to fluid displacement members other than an external gear with gear teeth, e.g., internal gear with gear teeth, a hub (e.g. a disk, cylinder, or other similar component) with projections (e.g. bumps, extensions, bulges, protrusions, other similar structures, or combinations thereof), a hub (e.g. a disk, cylinder, or other similar component) with indents (e.g., cavities, depressions, voids or similar structures), a gear body with lobes, or other similar structures that can displace fluid when driven.

Figure 1:
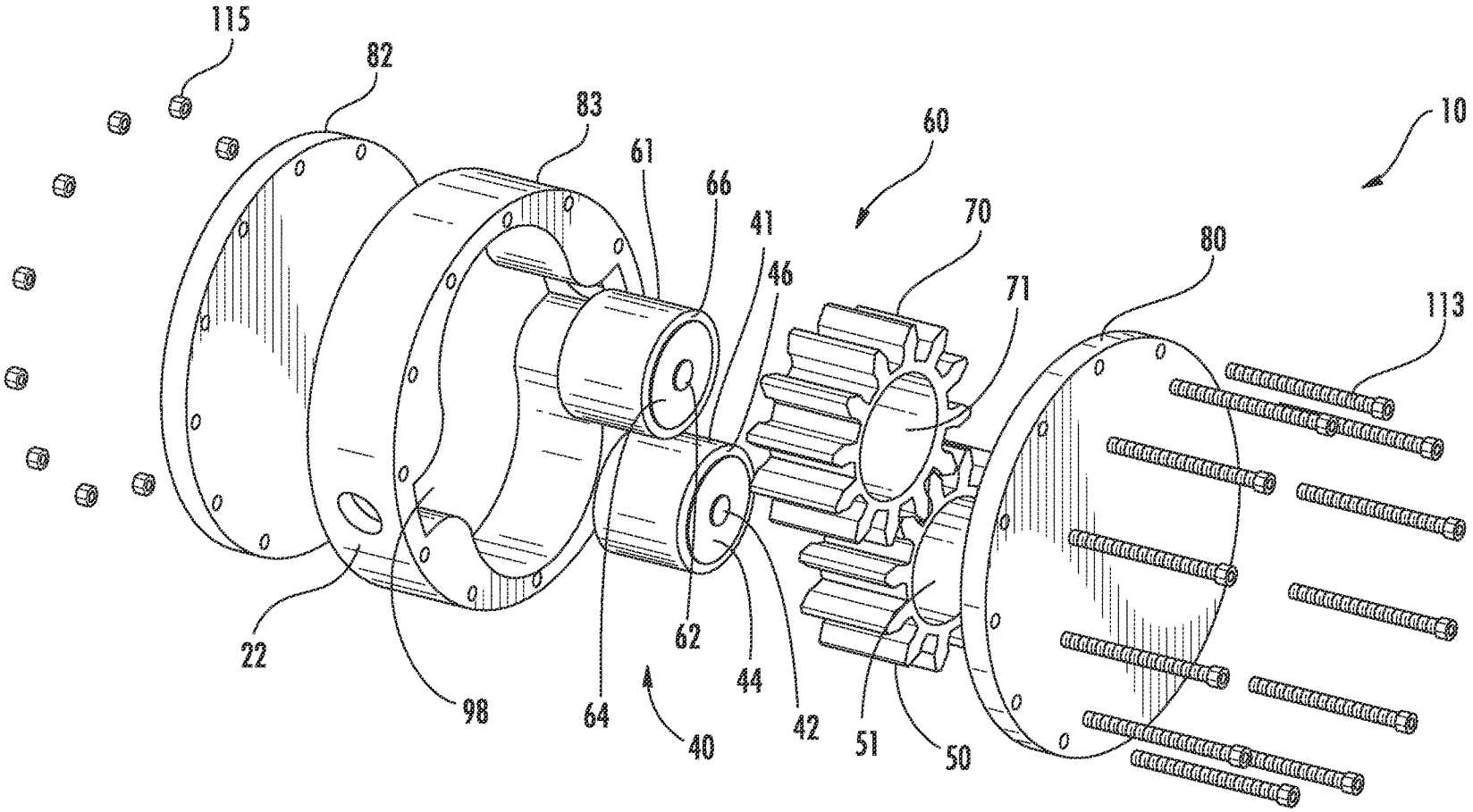
FIG. 1 illustrates an exploded view of an embodiment of an external gear pump that is consistent with the present invention.

FIG. 1 shows an exploded view of an embodiment of a pump 10 that is consistent with the present disclosure. The pump 10 includes two fluid drivers 40, 70 that respectively include motors 41, 61 (prime movers) and gears 50, 70 (fluid displacement members). In this embodiment, both pump motors 41, 61 are disposed inside the pump gears 50, 70. As seen in FIG. 1, the pump 10 represents a positive-displacement (or fixed displacement) gear pump. The pump 10 has a casing 20 that includes end plates 80, 82 and a pump body 83. These two plates 80, 82 and the pump body 83 can be connected by a plurality of through bolts 113 and nuts 115 and the inner surface 26 defines an inner volume 98. To prevent leakage, O-rings or other similar devices can be disposed between the end plates 80, 82 and the pump body 83. The casing 20 has a port 22 and a port 24 (see also FIG. 2), which are in fluid communication with the inner volume 98. During operation and based on the direction of flow, one of the ports 22, 24 is the pump inlet port and the other is the pump outlet port. In an exemplary embodiment, the ports 22, 24 of the casing 20 are round through-holes on opposing side walls of the casing 20. However, the shape is not limiting and the through-holes can have other shapes. In addition, one or both of the ports 22, 44 can be located on either the top or bottom of the casing. Of course, the ports 22, 24 must be located such that one port is on the inlet side of the pump and one port is on the outlet side of the pump.

As seen in FIG. 1, a pair of gears 50, 70 are disposed in the internal volume 98. Each of the gears 50, 70 has a plurality of gear teeth 52, 72 extending radially outward from the respective gear bodies. The gear teeth 52, 72, when rotated by, e.g., electric motors 41, 61, transfer fluid from the inlet to the outlet. In some embodiments, the pump 10 is bi-directional. Thus, either port 22, 24 can be the inlet port, depending on the direction of rotation of gears 50, 70, and the other port will be the outlet port. The gears 50, 70 have cylindrical openings 51, 71 along an axial centerline of the respective gear bodies. The cylindrical openings 51, 71 can extend either partially through or the entire length of the gear bodies. The cylindrical openings are sized to accept the pair of motors 41, 61. Each motor 41, 61 respectively includes a shaft 42, 62, a stator 44, 64, a rotor 46, 66.

Figure 2:
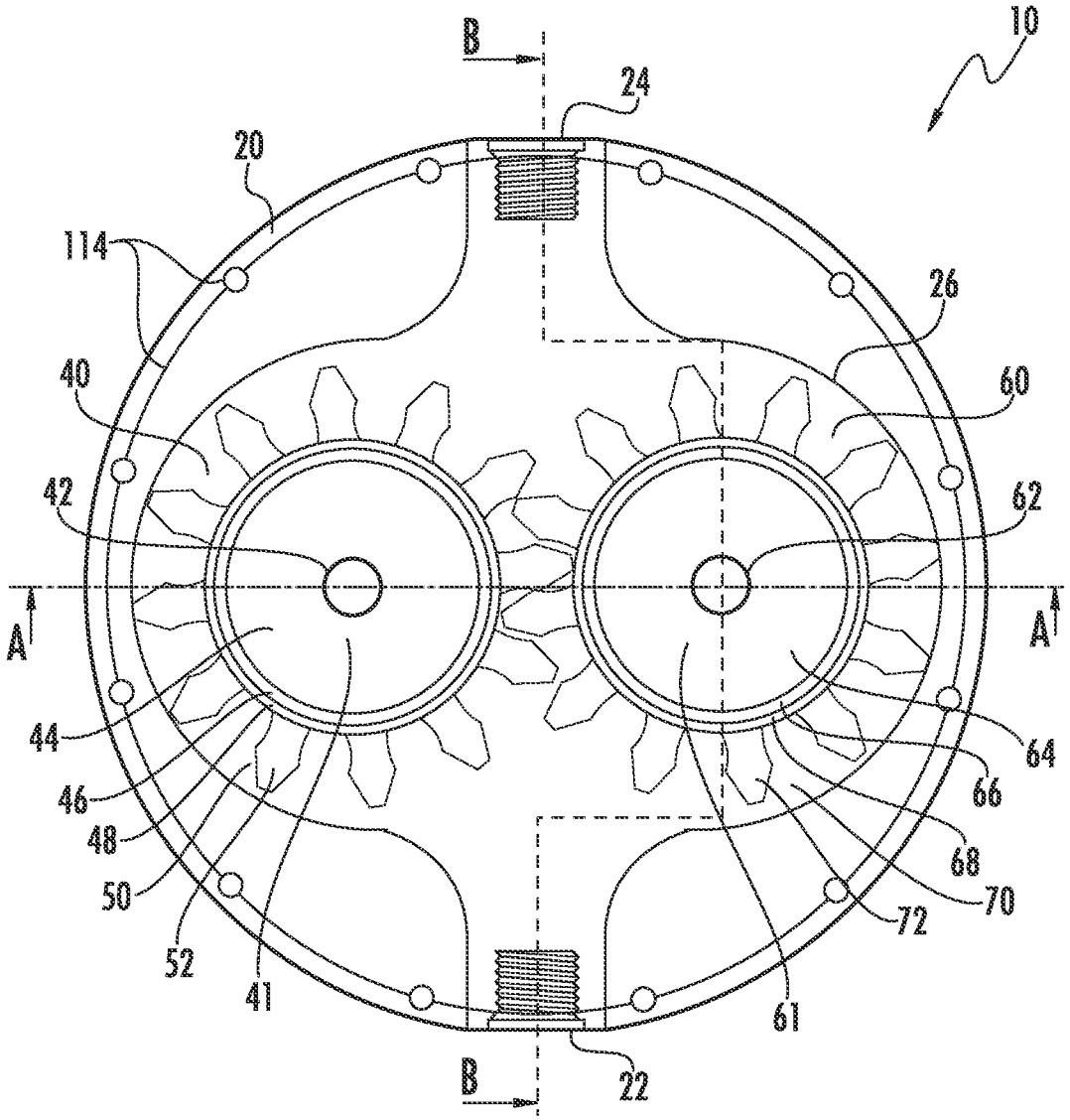
FIG. 2 shows a top cross-sectional view of the external gear pump of FIG. 1.
Figure 2A:
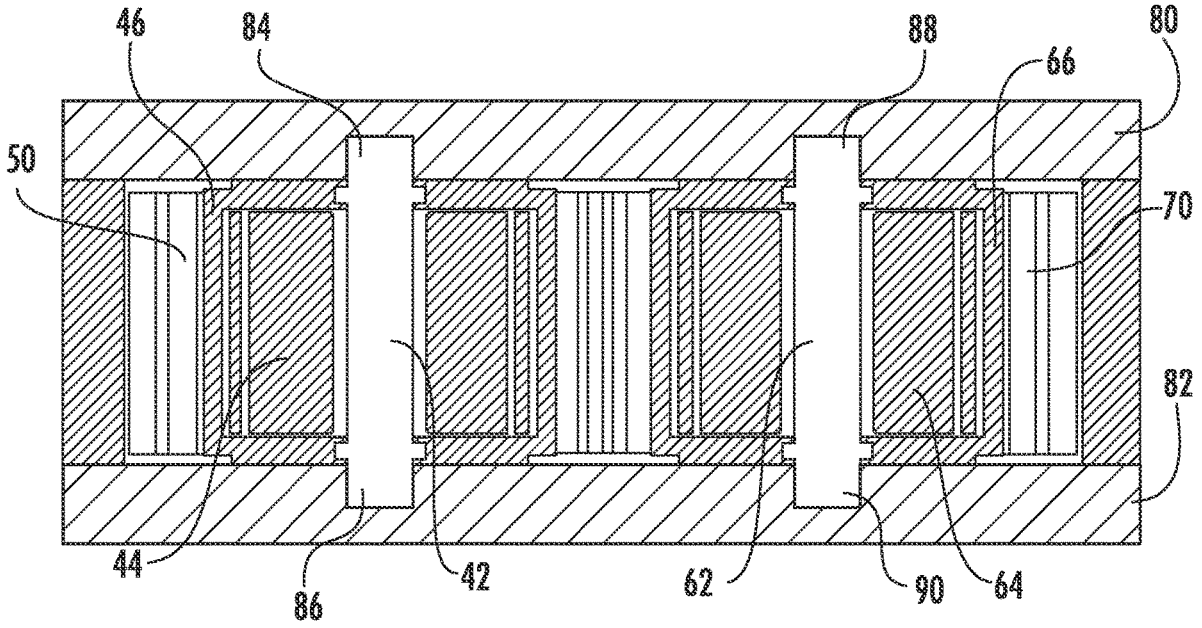
FIG. 2A shows a side cross-sectional view taken along a line A-A in FIG. 2 of the external gear pump.
Figure 2B:
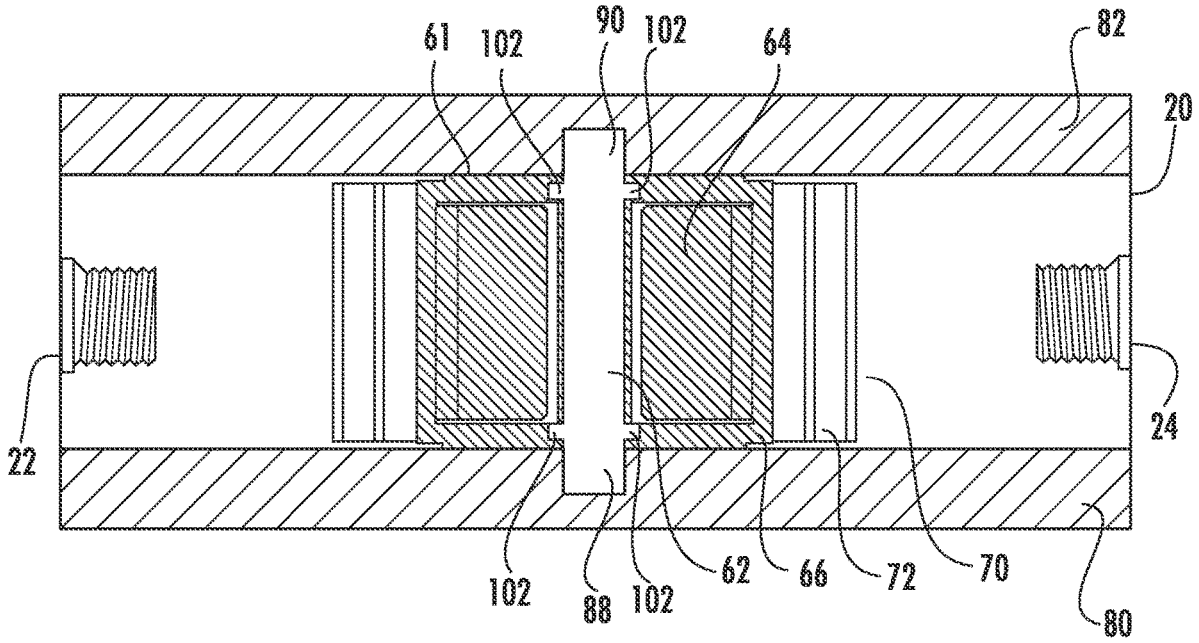
FIG. 2B shows a side cross-sectional view taken along a line B-B in FIG. 2 of a the external gear pump.

FIG. 2 shows a top cross-sectional view of the external gear pump 10 of FIG. 1. FIG. 2A shows a side cross-sectional view taken along a line A-A in FIG. 2 of the external gear pump 10, and FIG. 2 shows a side cross-sectional view taken along a line B-B in FIG. 2A of the external gear pump 10. As seen in FIGS. 2-2B, fluid drivers 40, 60 are disposed in the casing 20. The support shafts 42, 62 of the fluid drivers 40, 60 are disposed between the port 22 and the port 24 of the casing 20 and are supported by the upper plate 80 at one end 84 and the lower plate 82 at the other end 86. However, the means to support the shafts 42, 62 and thus the fluid drivers 40, 60 are not limited to this design and other designs to support the shaft can be used. For example, the shafts 42, 62 can be supported by blocks that are attached to the casing 20 rather than directly by casing 20. The support shaft 42 of the fluid driver 40 is disposed in parallel with the support shaft 62 of the fluid driver 60 and the two shafts are separated by an appropriate distance so that the gear teeth 52, 72 of the respective gears 50, 70 contact each other when rotated.

The stators 44, 64 of motors 41, 61 are disposed radially between the respective support shafts 42, 62 and the rotors 46, 66. The stators 44, 64 are fixedly connected to the respective support shafts 42, 62, which are fixedly connected to the casing 20. The rotors 46, 66 are disposed radially outward of the stators 44, 64 and surround the respective stators 44, 64. Thus, the motors 41, 61 in this embodiment are of an outer-rotor motor design (or an external-rotor motor design), which means that that the outside of the motor rotates and the center of the motor is stationary. In contrast, in an internal-rotor motor design, the rotor is attached to a central shaft that rotates. In an exemplary embodiment, the electric motors 41, 61 are multi directional motors. That is, either motor can operate to create rotary motion either clockwise or counter-clockwise depending on operational needs. Further, in an exemplary embodiment, the motors 41, 61 are variable speed motors in which the speed of the rotor and thus the attached gear can be varied to create various volume flows and pump pressures.

As discussed above, the gear bodies can include cylindrical openings 51, 71 which receive motors 41, 61. In an exemplary embodiment, the fluid drivers 40, 60 can respectively include outer support members 48, 68 (see FIG. 2) which aid in coupling the motors 41, 61 to the gears 50, 70 and in supporting the gears 50, 70 on motors 41,61. Each of the support members 48, 68 can be, for example, a sleeve that is initially attached to either an outer casing of the motors 41,61 or an inner surface of the cylindrical openings 51, 71. The sleeves can be attached by using an interference fit, a press fit, an adhesive, screws, bolts, a welding or soldering method, or other means that can attach the support members to the cylindrical openings. Similarly, the final coupling between the motors 41, 61 and the gears 50, 70 using the support members 48, 68 can be by using an interference fit, a press fit, screws, bolts, adhesive, a welding or soldering method, or other means to attach the motors to the support members. The sleeves can be of different thicknesses to, e.g., facilitate the attachment of motors 41, 61 with different physical sizes to the gears 50, 70 or vice versa. In addition, if the motor casings and the gears are made of materials that are not compatible, e.g., chemically or otherwise, the sleeves can be made of materials that are compatible with both the gear composition and motor casing composition. In some embodiments, the support members 48, 68 can be designed as a sacrificial piece. That is, support members 48, 68 are designed to be the first to fail, e.g., due to excessive stresses, temperatures, or other causes of failure, in comparison to the gears 50, 70 and motors 41, 61. This allows for a more economic repair of the pump 10 in the event of failure. In some embodiments, the outer support members 48, 68 is not a separate piece but an integral part of the casing for the motors 41, 61 or part of the inner surface of the cylindrical openings 51, 71 of the gears 50, 70. In other embodiments, the motors 41, 61 can support the gears 50, 70 (and the plurality of first gear teeth 52, 72) on their outer surfaces without the need for the outer support members 48, 68. For example, the motor casings can be directly coupled to the inner surface of the cylindrical opening 51, 71 of the gears 50, 70 by using an interference fit, a press fit, screws, bolts, an adhesive, a welding or soldering method, or other means to attach the motor casing to the cylindrical opening. In some embodiments, the outer casings of the motors 41, 61 can be, e.g., machined, cast, or other means to shape the outer casing to form a shape of the gear teeth 52, 72. In still other embodiments, the plurality of gear teeth 52, 72 can be integrated with the respective rotors 46, 66 such that each gear/rotor combination forms one rotary body.

In the above discussed exemplary embodiments, both fluid drivers 40, 60, including electric motors 41, 61and gears 50, 70, are integrated into a single pump casing 20. This novel configuration of the external gear pump 10 of the present disclosure enables a compact design that provides various advantages. First, the space or footprint occupied by the gear pump embodiments discussed above is significantly reduced by integrating necessary components into a single pump casing, when compared to conventional gear pumps. In addition, the total weight of a pump system consistent with the above embodiments is also reduced by removing unnecessary parts such as a shaft that connects a motor to a pump, and separate mountings for a motor/gear driver. Further, since the pump 10 of the present disclosure has a compact and modular design, it can be easily installed, even at locations where conventional gear pumps could not be installed, and can be easily replaced. Detailed description of the pump operation is provided next.

Figure 3:
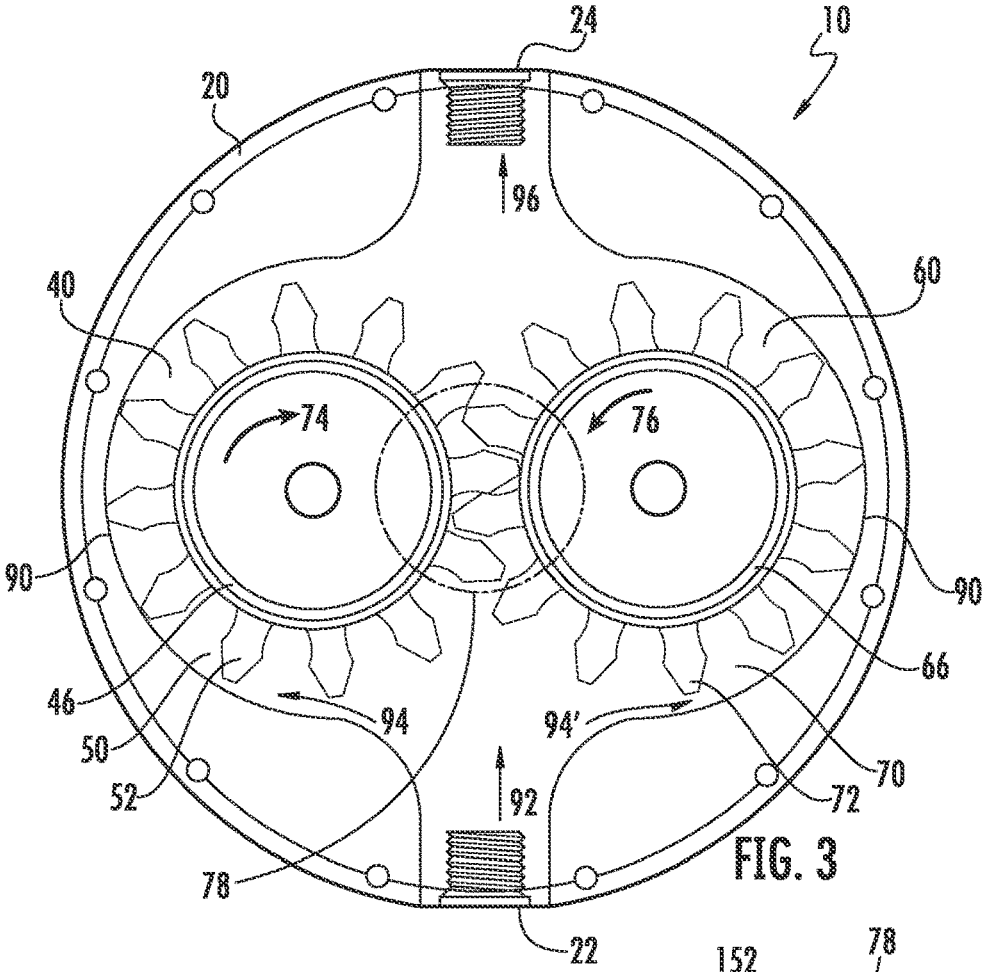
FIG. 3 illustrates exemplary flow paths of the fluid pumped by the external gear pump of FIG. 1.

FIG. 3 illustrates an exemplary fluid flow path of an exemplary embodiment of the external gear pump 10. The ports 22, 24, and a contact area 78 between the plurality of first gear teeth 52 and the plurality of second gear teeth 72 are substantially aligned along a single straight path. However, the alignment of the ports are not limited to this exemplary embodiment and other alignments are permissible. For explanatory purpose, the gear 50 is rotatably driven clockwise 74 by motor 41 and the gear 70 is rotatably driven counter-clockwise 76 by the motor 61. With this rotational configuration, port 22 is the inlet side of the gear pump 10 and port 24 is the outlet side of the gear pump 10. In some exemplary embodiments, both gears 50, 70 are respectively independently driven by the separately provided motors 41, 61.

As seen in FIG. 3, the fluid to be pumped is drawn into the casing 20 at port 22 as shown by an arrow 92 and exits the pump 10 via port 24 as shown by arrow 96. The pumping of the fluid is accomplished by the gear teeth 52, 72. As the gear teeth 52, 72 rotate, the gear teeth rotating out of the contact area 78 form expanding inter-tooth volumes between adjacent teeth on each gear. As these inter-tooth volumes expand, the spaces between adjacent teeth on each gear are filled with fluid from the inlet port, which is port 22 in this exemplary embodiment. The fluid is then forced to move with each gear along the interior wall 90 of the casing 20 as shown by arrows 94 and 94'. That is, the teeth 52 of gear 50 force the fluid to flow along the path 94 and the teeth 72 of gear 70 force the fluid to flow along the path 94'. Very small clearances between the tips of the gear teeth 52, 72 on each gear and the corresponding interior wall 90 of the casing 20 keep the fluid in the inter-tooth volumes trapped, which prevents the fluid from leaking back towards the inlet port. As the gear teeth 52, 72 rotate around and back into the contact area 78, shrinking inter-tooth volumes form between adjacent teeth on each gear because a corresponding tooth of the other gear enters the space between adjacent teeth. The shrinking inter-tooth volumes force the fluid to exit the space between the adjacent teeth and flow out of the pump 10 through port 24 as shown by arrow 96. In some embodiments, the motors 41, 61 are bi-directional and the rotation of motors 41, 61 can be reversed to reverse the direction fluid flow through the pump 10, i.e., the fluid flows from the port 24 to the port 22.

To prevent backflow, i.e., fluid leakage from the outlet side to the inlet side through the contact area 78, contact between a tooth of the first gear 50 and a tooth of the second gear 70 in the contact area 78 provides sealing against the backflow. The contact force is sufficiently large enough to provide substantial sealing but, unlike related art systems, the contact force is not so large as to significantly drive the other gear. In related art driver-driven systems, the force applied by the driver gear turns the driven gear. That is, the driver gear meshes with (or interlocks with) the driven gear to mechanically drive the driven gear. While the force from the driver gear provides sealing at the interface point between the two teeth, this force is much higher than that necessary for sealing because this force must be sufficient enough to mechanically drive the driven gear to transfer the fluid at the desired flow and pressure. This large force causes material to shear off from the teeth in related art pumps. These sheared materials can be dispersed in the fluid, travel through the hydraulic system, and damage crucial operative components, such as O-rings and bearings. As a result, a whole pump system can fail and could interrupt operation of the pump. This failure and interruption of the operation of the pump can lead to significant downtime to repair the pump.

In exemplary embodiments of the pump 10, however, the gears 50, 70 of the pump 10 do not mechanically drive the other gear to any significant degree when the teeth 52, 72 form a seal in the contact area 78. Instead, the gears 50, 70 are rotatably driven independently such that the gear teeth 52, 72 do not grind against each other. That is, the gears 50, 70 are synchronously driven to provide contact but not to grind against each other. Specifically, rotation of the gears 50, 70 are synchronized at suitable rotation rates so that a tooth of the gear 50 contacts a tooth of the second gear 70 in the contact area 78 with sufficient enough force to provide substantial sealing, i.e., fluid leakage from the outlet port side to the inlet port side through the contact area 78 is substantially eliminated. However, unlike the driver-driven configurations discussed above, the contact force between the two gears is insufficient to have one gear mechanically drive the other to any significant degree. Precision control of the motors 41, 61, will ensure that the gear positions remain synchronized with respect to each other during operation. Thus, the above-described issues caused by sheared materials in conventional gear pumps are effectively avoided.

In some embodiments, rotation of the gears 50, 70 is at least 99% synchronized, where 100% synchronized means that both gears 50, 70 are rotated at the same rpm. However, the synchronization percentage can be varied as long as substantial sealing is provided via the contact between the gear teeth of the two gears 50, 70. In exemplary embodiments, the synchronization rate can be in a range of 95.0% to 100% based on a clearance relationship between the gear teeth 52 and the gear teeth 72. In other exemplary embodiments, the synchronization rate is in a range of 99.0% to 100% based on a clearance relationship between the gear teeth 52 and the gear teeth 72, and in still other exemplary embodiments, the synchronization rate is in a range of 99.5% to 100% based on a clearance relationship between the gear teeth 52 and the gear teeth 72. Again, precision control of the motors 41, 61, will ensure that the gear positions remain synchronized with respect to each other during operation. By appropriately synchronizing the gears 50, 70, the gear teeth 52, 72 can provide substantial sealing, e.g., a backflow or leakage rate with a slip coefficient in a range of 5% or less. For example, for typical hydraulic fluid at about 120 deg. F, the slip coefficient can be can be 5% or less for pump pressures in a range of 3000 psi to 5000 psi, 3% or less for pump pressures in a range of 2000 psi to 3000 psi, 2% or less for pump pressures in a range of 1000 psi to 2000 psi, and 1% or less for pump pressures in a range up to 1000 psi. Of course, depending on the pump type, the synchronized contact can aid in pumping the fluid. For example, in certain internal-gear gerotor designs, the synchronized contact between the two fluid drivers also aids in pumping the fluid, which is trapped between teeth of opposing gears. In some exemplary embodiments, the gears 50, 70 are synchronized by appropriately synchronizing the motors 41, 61. Synchronization of multiple motors is known in the relevant art, thus detailed explanation is omitted here.

Figure 3A:
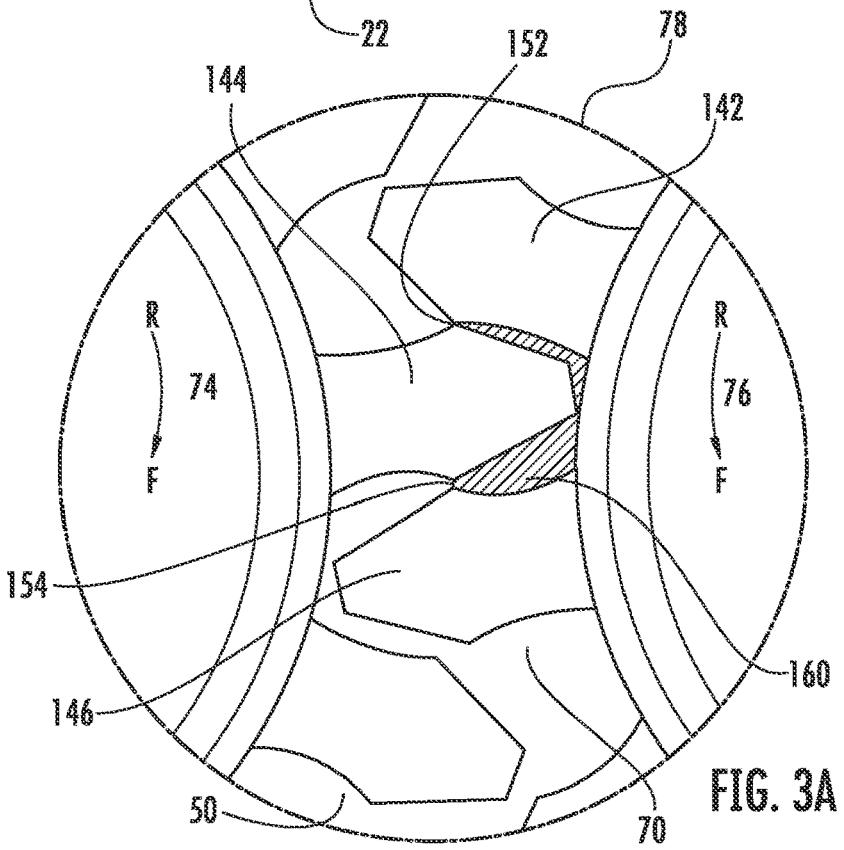
FIG. 3A shows a cross-sectional view illustrating one-sided contact between two gears in a contact area in the external gear pump of FIG. 3.
Figure 4:
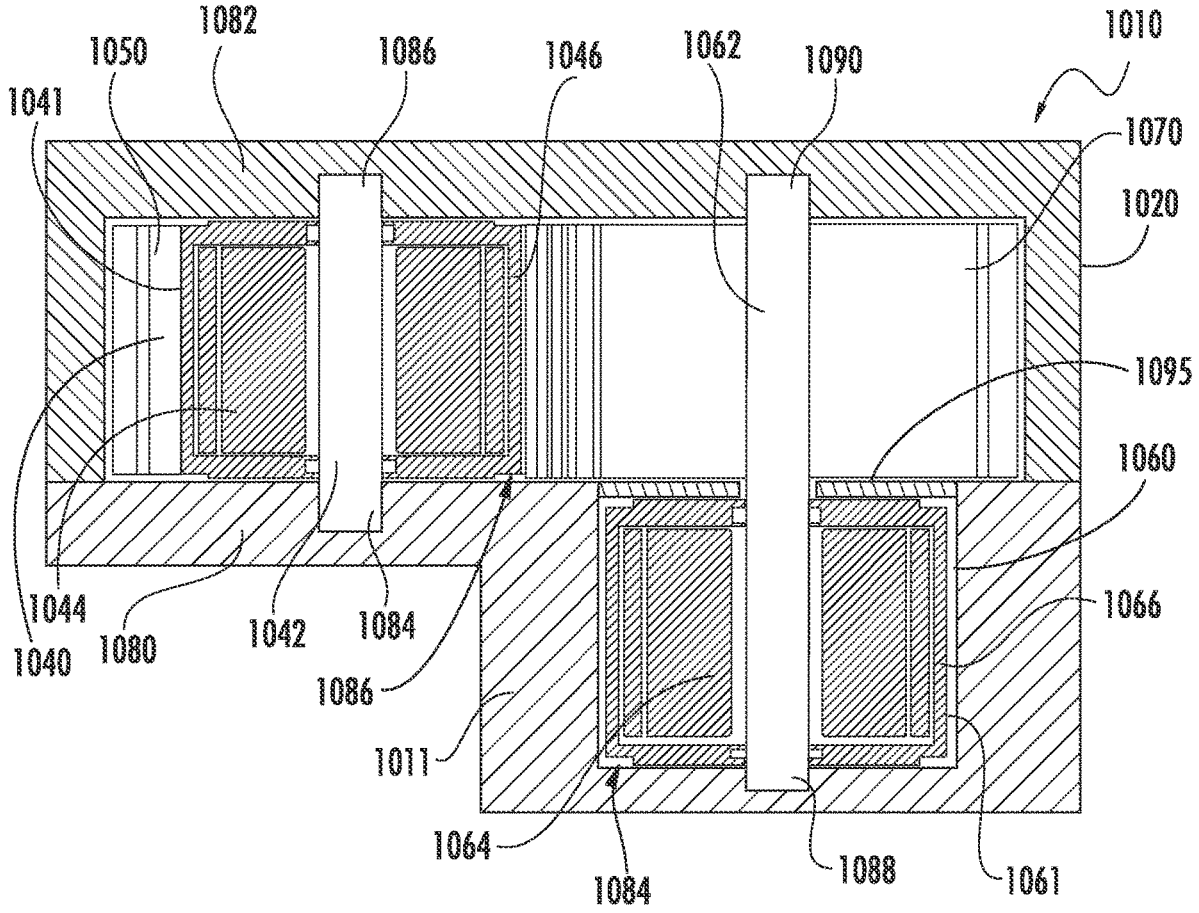
FIGS. 4-8 show side cross-sectional views of various embodiments of external gear pumps that are consistent with the present invention.

In an exemplary embodiment, the synchronizing of the gears 50, 70 provides one-sided contact between a tooth of the gear 50 and a tooth of the gear 70. FIG. 3A shows a cross-sectional view illustrating this one-sided contact between the two gears 50, 70 in the contact area 78. For illustrative purposes, gear 50 is rotatably driven clockwise 74 and the gear 70 is rotatably driven counter-clockwise 76 independently of the gear 50. Further, the gear 70 is rotatably driven faster than the gear 50 by a fraction of a second, 0.01 sec/revolution, for example. This rotational speed difference between the gear 50 and gear 70 enables one-sided contact between the two gears 50, 70, which provides substantial sealing between gear teeth of the two gears 50, 70 to seal between the inlet port and the outlet port, as described above. Thus, as shown in FIG. 4, a tooth 142 on the gear 70 contacts a tooth 144 on the gear 50 at a point of contact 152. If a face of a gear tooth that is facing forward in the rotational direction 74, 76 is defined as a front side (F), the front side (F) of the tooth 142 contacts the rear side (R) of the tooth 144 at the point of contact 152. However, the gear tooth dimensions are such that the front side (F) of the tooth 144 is not in contact with (i.e., spaced apart from) the rear side (R) of tooth 146, which is a tooth adjacent to the tooth 142 on the gear 70. Thus, the gear teeth 52, 72 are designed such that there is one-sided contact in the contact area 78 as the gears 50, 70 are driven. As the tooth 142 and the tooth 144 move away from the contact area 78 as the gears 50, 70 rotate, the one-sided contact formed between the teeth 142 and 144 phases out. As long as there is a rotational speed difference between the two gears 50, 70, this one-sided contact is formed intermittently between a tooth on the gear 50 and a tooth on the gear 70. However, because as the gears 50, 70 rotate, the next two following teeth on the respective gears form the next one-sided contact such that there is always contact and the backflow path in the contact area 78 remains substantially sealed. That is, the one-sided contact provides sealing between the ports 22 and 24 such that fluid carried from the pump inlet to the pump outlet is prevented (or substantially prevented) from flowing back to the pump inlet through the contact area 78.

In FIG. 3A, the one-sided contact between the tooth 142 and the tooth 144 is shown as being at a particular point, i.e. point of contact 152. However, a one-sided contact between gear teeth in the exemplary embodiments is not limited to contact at a particular point. For example, the one-sided contact can occur at a plurality of points or along a contact line between the tooth 142 and the tooth 144. For another example, one-sided contact can occur between surface areas of the two gear teeth. Thus, a sealing area can be formed when an area on the surface of the tooth 142 is in contact with an area on the surface of the tooth 144 during the one-sided contact. The gear teeth 52, 72 of each gear 50, 70 can be configured to have a tooth profile (or curvature) to achieve one-sided contact between the two gear teeth. In this way, one-sided contact in the present disclosure can occur at a point or points, along a line, or over surface areas. Accordingly, the point of contact 152 discussed above can be provided as part of a location (or locations) of contact, and not limited to a single point of contact.

In some exemplary embodiments, the teeth of the respective gears 50, 70 are designed so as to not trap excessive fluid pressure between the teeth in the contact area 78. As illustrated in FIG. 3A, fluid 160 can be trapped between the teeth 142, 144, 146. While the trapped fluid 160 provides a sealing effect between the pump inlet and the pump outlet, excessive pressure can accumulate as the gears 50, 70 rotate. In a preferred embodiment, the gear teeth profile is such that a small clearance (or gap) 154 is provided between the gear teeth 144, 146 to release pressurized fluid. Such a design retains the sealing effect while ensuring that excessive pressure is not built up. Of course, the point, line or area of contact is not limited to the side of one tooth face contacting the side of another tooth face. Depending on the type of fluid displacement member, the synchronized contact can be between any surface of at least one projection (e.g., bump, extension, bulge, protrusion, other similar structure or combinations thereof) on the first fluid displacement member and any surface of at least one projection(e.g., bump, extension, bulge, protrusion, other similar structure or combinations thereof) or an indent(e.g., cavity, depression, void or similar structure) on the second fluid displacement member. In some embodiments, at least one of the fluid displacement members can be made of or include a resilient material, e.g., rubber, an elastomeric material, or another resilient material, so that the contact force provides a more positive sealing area.

In the embodiments discussed above, the prime movers are disposed inside the fluid displacement members, i.e., both motors 41, 61 are disposed inside the cylinder openings 51, 71. However, advantageous features of the inventive pump design are not limited to a configuration in which both prime movers are disposed within the bodies of the fluid displacement members. Other drive-drive configurations also fall within the scope of the present disclosure. For example, FIG. 4 shows a side cross-sectional view of another exemplary embodiment of an external gear pump 1010. The embodiment of the pump 1010 shown in FIG. 4 differs from pump 10 (FIG. 1) in that one of the two motors in this embodiment is external to the corresponding gear body but is still in the pump casing. The pump 1010 includes a casing 1020, a fluid driver 1040, and a fluid driver 1060. The inner surface of the casing 1020 defines an internal volume that includes a motor cavity 1084 and a gear cavity 1086. The casing 1020 can include end plates 1080, 1082. These two plates 1080, 1082 can be connected by a plurality of bolts (not shown).

The fluid driver 1040 includes motor 1041 and a gear 1050. The motor 1041 is an outer-rotor motor design and is disposed in the body of gear 1050, which is disposed in the gear cavity 1086. The motor 1041 includes a rotor 1044 and a stator 1046. The gear 1050 includes a plurality of gear teeth 1052 extending radially outward from its gear body. It should be understood that those skilled in the art will recognize that fluid driver 1040 is similar to fluid driver 40 and that the configurations and functions of fluid driver 40, as discussed above, can be incorporated into fluid driver 1040. Accordingly, for brevity, fluid driver 1040 will not be discussed in detail except as necessary to describe this embodiment.

The fluid driver 1060 includes a motor 1061 and a gear 1070. The fluid driver 1060 is disposed next to fluid driver 1040 such that the respective gear teeth 1072, 1052 contact each other in a manner similar to the contact of gear teeth 52, 72 in contact area 78 discussed above with respect to pump 10. In this embodiment, motor 1061 is an inner-rotor motor design and is disposed in the motor cavity 1084. In this embodiment, the motor 1061 and the gear 1070 have a common shaft 1062. The rotor 1064 of motor 1061 is disposed radially between the shaft 1062 and the stator 1066. The stator 1066 is disposed radially outward of the rotor 1064 and surrounds the rotor 1064. The inner-rotor design means that the shaft 1062, which is connected to rotor 1064, rotates while the stator 1066 is fixedly connected to the casing 1020. In addition, gear 1070 is also connected to the shaft 1062. The shaft 1062 is supported by, for example, a bearing in the plate 1080 at one end 1088 and by a bearing in the plate 1082 at the other end 1090. In other embodiments, the shaft 1062 can be supported by bearing blocks that are fixedly connected to the casing 1020 rather than directly by bearings in the casing 1020. In addition, rather than a common shaft 1062, the motor 1061 and the gear 1070 can include their own shafts that are coupled together by known means.

As shown in FIG. 4, the gear 1070 is disposed adjacent to the motor 1061 in the casing 1020. That is, unlike motor 1041, the motor 1061 is not disposed in the gear body of gear 1070. The gear 1070 is spaced apart from the motor 1061 in an axial direction on the shaft 1062. The rotor 1064 is fixedly connected to the shaft 1062 on one side 1088 of the shaft 1062, and the gear 1070 is fixedly connected to the shaft 1062 on the other side 1090 of the shaft 1062 such that torque generated by the motor 1061 is transmitted to the gear 1070 via the shaft 1062.

The motor 1061 is designed to fit into its cavity with sufficient tolerance between the motor casing and the pump casing 1020 so that fluid is prevented (or substantially prevented) from entering the cavity during operation. In addition, there is sufficient clearance between the motor casing and the gear 1070 for the gear 1070 to rotate freely but the clearance is such that the fluid can still be pumped efficiently. Thus, with respect to the fluid, in this embodiment, the motor casing is designed to perform the function of the appropriate portion of the pump casing walls of the embodiment of FIG. 1. In some embodiments, the outer diameter of the motor 1061 is less that the root diameter for the gear teeth 1072. Thus, in these embodiments, even the motor side of the gear teeth 1072 will be adjacent to a wall of the pump casing 1020 as they rotate. In some embodiments, a bearing 1095 can be inserted between the gear 1070 and the motor 1061. The bearing 1095, which can be, e.g., a washer-type bearing, decreases friction between the gear 1070 and the motor 1061 as the gear 1070 rotates. Depending on the fluid being pumped and the type of application, the bearing can be metallic, a non-metallic or a composite. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. In addition, the bearing 1095 can be sized to fit the motor cavity 1084 opening to help seal the motor cavity 1084 from the gear cavity 1086, and the gears 1052, 1072 will be able to pump the fluid more efficiently. It should be understood that those skilled in the art will recognize that, in operation, the fluid driver 1040 and the fluid driver 1060 will operate in a manner similar to that disclosed above with respect to pump 10. Accordingly, for brevity, pump 1010 operating details will not be further discussed.

In the above exemplary embodiment, the gear 1070 is shown as being spaced apart from the motor 1061 along the axial direction of the shaft 1062. However, other configurations fall within the scope of the present disclosure. For example, the gear 1070 and motor 1061 can be completely separated from each other (e.g., without a common shaft), partially overlapping with each other, positioned side-by-side, on top of each other, or offset from each other. Thus, the present disclosure covers all of the above-discussed positional relationships and any other variations of a relatively proximate positional relationship between a gear and a motor inside the casing 1020. In addition, in some exemplary embodiments, motor 1061 can be an outer-rotor motor design that is appropriately configured to rotate the gear 1070.

Further, in the exemplary embodiment described above, the torque of the motor 1061 is transmitted to the gear 1070 via the shaft 1062. However, the means for transmitting torque (or power) from a motor to a gear is not limited to a shaft, e.g., the shaft 1062 in the above-described exemplary embodiment. Instead, any combination of power transmission devices, e.g., shafts, sub-shafts, belts, chains, couplings, gears, connection rods, cams, or other power transmission devices, can be used without departing from the spirit of the present disclosure.

Figure 5:
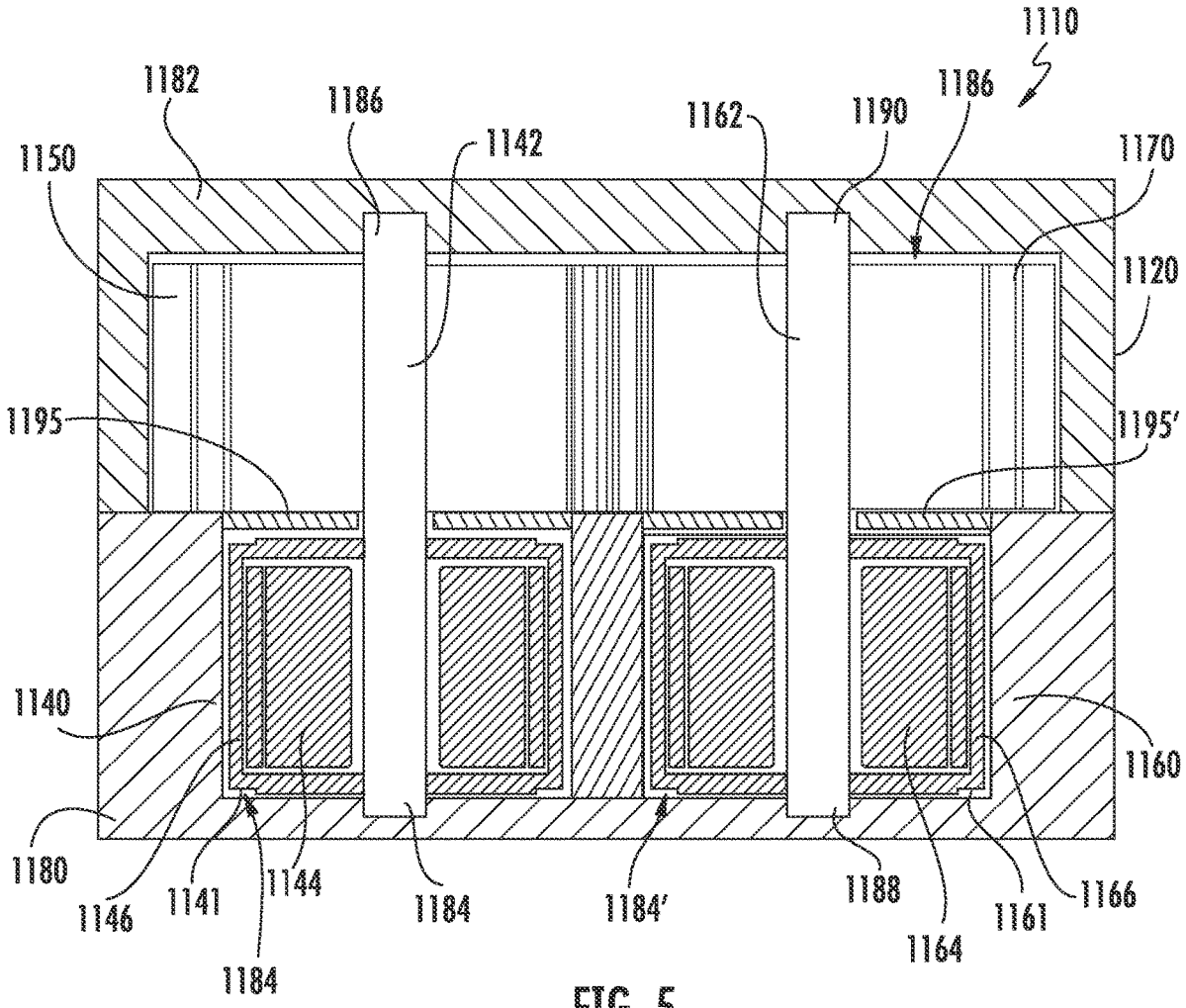

FIG. 5 shows a side cross-sectional view of another exemplary embodiment of an external gear pump 1110. The embodiment of the pump 1110 shown in FIG. 5 differs from pump 10 in that each of the two motors in this embodiment is external to the gear body but still disposed in the pump casing. The pump 1110 includes a casing 1120, a fluid driver 1140, and a fluid driver 1160. The inner surface of the casing 1120 defines an internal volume that includes motor cavities 1184 and 1184' and gear cavity 1186. The casing 1120 can include end plates 1180, 1182. These two plates 1180, 1182 can be connected by a plurality of bolts (not shown).

The fluid drivers 1140, 1160 respectively include motors 1141, 1161 and gears 1150, 1170. The motors 1141, 1161 are of an inner-rotor design and are respectively disposed in motor cavities 1184, 1184'. The motor 1141 and gear 1150 of the fluid driver 1140 have a common shaft 1142 and the motor 1161 and gear 1170 of the fluid driver 1160 have a common shaft 1162. The motors 1141, 1161 respectively include rotors 1144, 1164 and stators 1146, 1166, and the gears 1150, 1170 respectively include a plurality of gear teeth 1152, 1172 extending radially outward from the respective gear bodies. The fluid driver 1140 is disposed next to fluid driver 1160 such that the respective gear teeth 1152, 1172 contact each other in a manner similar to the contact of gear teeth 52, 72 in contact area 78 discussed above with respect to pump 10. Bearings 1195 and 1195' can be respectively disposed between motors 1141, 1161 and gears 1150, 1170. The bearings 1195 and 1195' are similar in design and function to bearing 1095 discussed above. It should be understood that those skilled in the art will recognize that the fluid drivers 1140, 1160 are similar to fluid driver 1060 and that the configurations and functions of the fluid driver 1060, discussed above, can be incorporated into the fluid drivers 1140, 1160 within pump 1110. Thus, for brevity, fluid drivers 1140, 1160 will not be discussed in detail. Similarly, the operation of pump 1110 is similar to that of pump 10 and thus, for brevity, will not be further discussed. In addition, like fluid driver 1060, the means for transmitting torque (or power) from the motor to the gear is not limited to a shaft. Instead, any combination of power transmission devices, for example, shafts, sub-shafts, belts, chains, couplings, gears, connection rods, cams, or other power transmission devices can be used without departing from the spirit of the present disclosure. In addition, in some exemplary embodiments, motors 1141, 1161 can be outer-rotor motor designs that are appropriately configured to respectively rotate the gears 1150, 1170.

Figure 6:
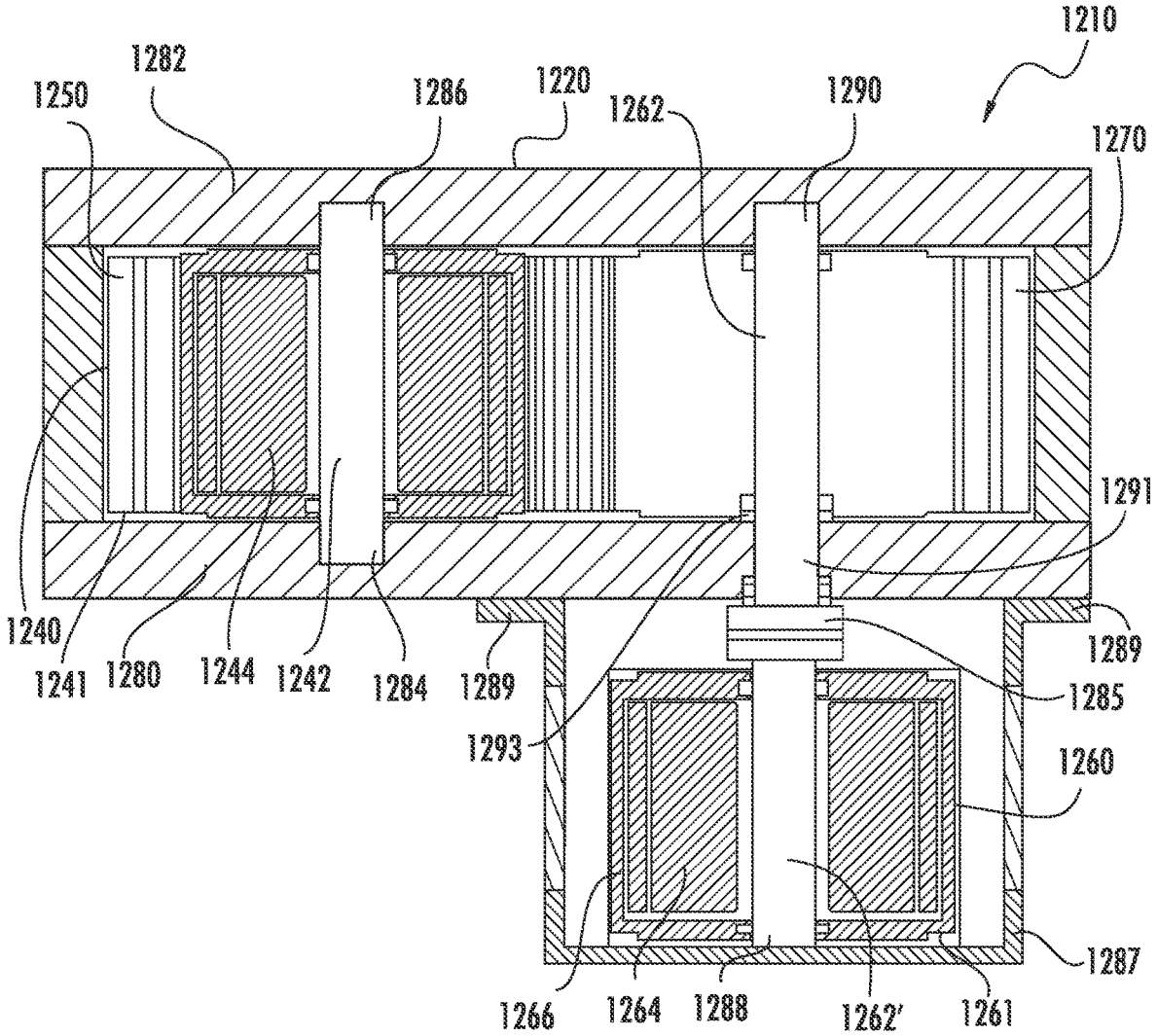

FIG. 6 shows a side cross-sectional view of another exemplary embodiment of an external gear pump 1210. The embodiment of the pump 1210 shown in FIG. 6 differs from pump 10 in that one of the two motors is disposed outside the pump casing. The pump 1210 includes a casing 1220, a fluid driver 1240, and a fluid driver 1260. The inner surface of the casing 1220 defines an internal volume. The casing 1220 can include end plates 1280, 1282. These two plates 1280, 1282 can be connected by a plurality of bolts.

The fluid driver 1240 includes motor 1241 and a gear 1250. The motor 1241 is an outer-rotor motor design and is disposed in the body of gear 1250, which is disposed in the internal volume. The motor 1241 includes a rotor 1244 and a stator 1246. The gear 1250 includes a plurality of gear teeth 1252 extending radially outward from its gear body. It should be understood that those skilled in the art will recognize that fluid driver 1240 is similar to fluid driver 40 and that the configurations and functions of fluid driver 40, as discussed above, can be incorporated into fluid driver 1240. Accordingly, for brevity, fluid driver 1240 will not be discussed in detail except as necessary to describe this embodiment.

The fluid driver 1260 includes a motor 1261 and a gear 1270. The fluid driver 1260 is disposed next to fluid driver 1240 such that the respective gear teeth 1272, 1252 contact each other in a manner similar to the contact of gear teeth 52, 72 in contact area 78 discussed above with respect to pump 10. In this embodiment, motor 1261 is an inner-rotor motor design and, as seen in FIG. 6, the motor 1261 is disposed outside the casing 1220. The rotor 1264 of motor 1261 is disposed radially between the motor shaft 1262' and the stator 1266. The stator 1266 is disposed radially outward of the rotor 1264 and surrounds the rotor 1264. The inner-rotor design means that the shaft 1262', which is coupled to rotor 1264, rotates while the stator 1266 is fixedly connected to the pump casing 1220 either directly or indirectly via, e.g., motor housing 1287. The gear 1270 includes a shaft 1262 that can be supported by the plate 1282 at one end 1290 and the plate 1280 at the other end 1291. The gear shaft 1262, which extends outside casing 1220, can be coupled to motor shaft 1262' via, e.g., a coupling 1285 such as a shaft hub to form a shaft extending from point 1290 to point 1288. One or more seals 1293 can be disposed to provide necessary sealing of the fluid. Design of the shafts 1262, 1262' and the means to couple the motor 1261 to gear 1270 can be varied without departing from the spirit of the present invention.

As shown in FIG. 6, the gear 1270 is disposed proximate the motor 1261. That is, unlike motor 1241, the motor 1261 is not disposed in the gear body of gear 1270. Instead, the gear 1270 is disposed in the casing 1220 while the motor 1261 is disposed proximate to the gear 1270 but outside the casing 1220. In the exemplary embodiment of FIG. 6, the gear 1270 is spaced apart from the motor 1261 in an axial direction along the shafts 1262 and 1262'. The rotor 1266 is fixedly connected to the shaft 1262', which is couple to shaft 1262 such that the torque generated by the motor 1261 is transmitted to the gear 1270 via the shaft 1262. The shafts 1262 and 1262' can be supported by bearings at one or more locations. It should be understood that those skilled in the art will recognize that the operation of pump 1210, including fluid drivers 1240, 1260, will be similar to that of pump 10 and thus, for brevity, will not be further discussed.

In the above embodiment gear 1270 is shown spaced apart from the motor 1261 along the axial direction of the shafts 1262 and 1262' (i.e., spaced apart but axially aligned). However, other configurations can fall within the scope of the present disclosure. For example, the gear 1270 and motor 1261 can be positioned side-by-side, on top of each other, or offset from each other. Thus, the present disclosure covers all of the above-discussed positional relationships and any other variations of a relatively proximate positional relationship between a gear and a motor outside the casing 1220. In addition, in some exemplary embodiments, motor 1261 can be an outer-rotor motor design that is appropriately configured to rotate the gear 1270.

Further, in the exemplary embodiment described above, the torque of the motor 1261 is transmitted to the gear 1270 via the shafts 1262, 1262'. However, the means for transmitting torque (or power) from a motor to a gear is not limited to shafts. Instead, any combination of power transmission devices, e.g., shafts, sub-shafts, belts, chains, couplings, gears, connection rods, cams, or other power transmission devices, can be used without departing from the spirit of the present disclosure. In addition, the motor housing 1287 can include a vibration isolator (not shown) between the casing 1220 and the motor housing 1287. Further, the motor housing 1287 mounting is not limited to that illustrated in FIG. 6 and the motor housing can be mounted at any appropriate location on the casing 1220 or can even be separate from the casing 1220.

Figure 7:
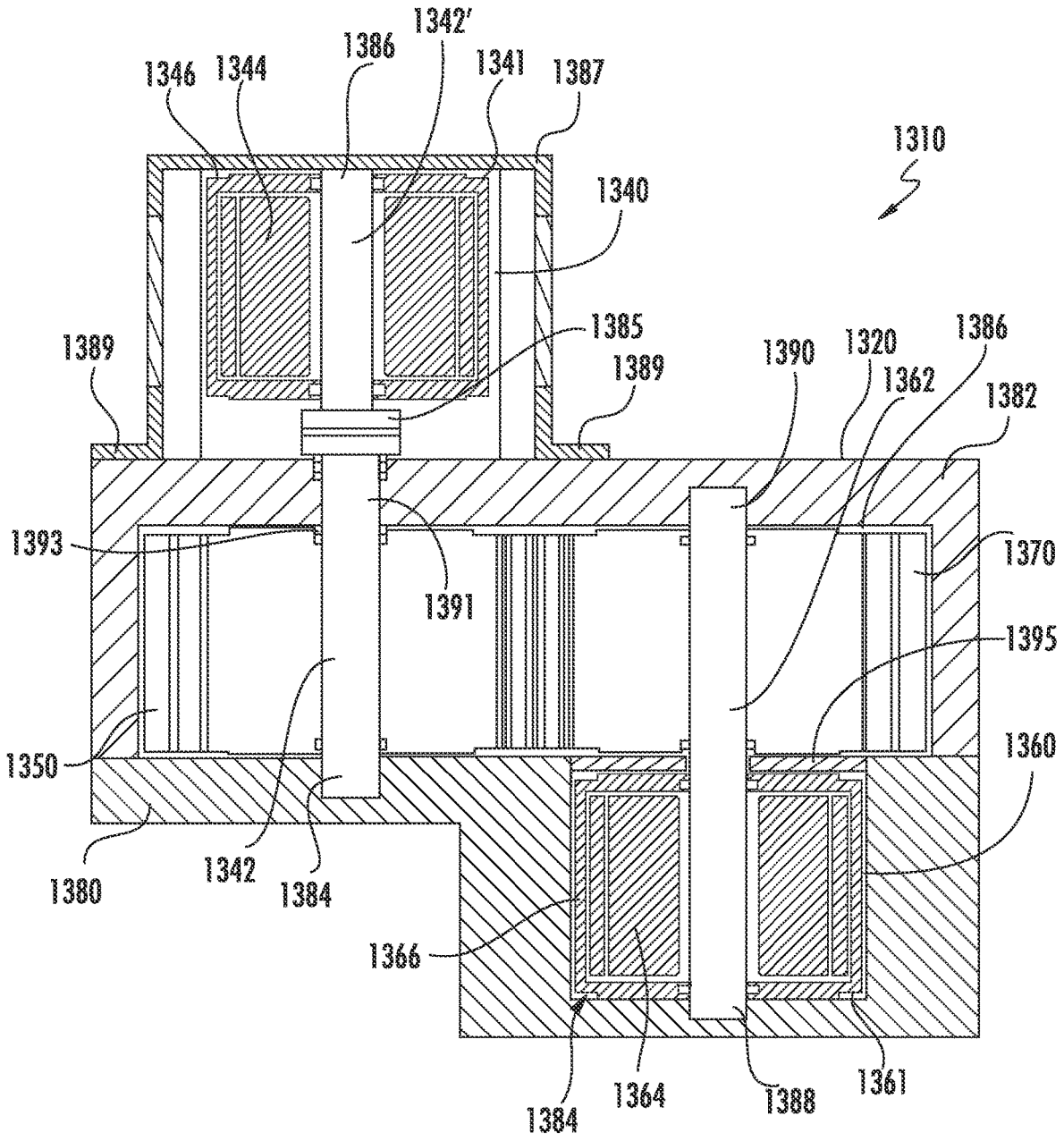

FIG. 7 shows a side cross-sectional view of another exemplary embodiment of an external gear pump 1310. The embodiment of the pump 1310 shown in FIG. 7 differs from pump 10 in that the two motors are disposed external to the gear body with one motor still being disposed inside the pump casing while the other motor is disposed outside the pump casing. The pump 1310 includes a casing 1320, a fluid driver 1340, and a fluid driver 1360. The inner surface of the casing 1320 defines an internal volume that includes a motor cavity 1384 and a gear cavity 1386. The casing 1320 can include end plates 1380, 1382. These two plates 1380, 1382 can be connected to a body of the casing 1320 by a plurality of bolts.

The fluid driver 1340 includes a motor 1341 and a gear 1350. In this embodiment, motor 1341 is an inner-rotor motor design and, as seen in FIG. 7, the motor 1341 is disposed outside the casing 1320. The rotor 1344 of motor 1341 is disposed radially between the motor shaft 1342' and the stator 1346. The stator 1346 is disposed radially outward of the rotor 1344 and surrounds the rotor 1344. The inner rotor design means that the shaft 1342', which is connected to rotor 1344, rotates while the stator 1346 is fixedly connected to the pump casing 1320 either directly or indirectly via, e.g., motor housing 1387. The gear 1350 includes a shaft 1342 that can be supported by the lower plate 1382 at one end 1390 and the upper plate 1380 at the other end 1391. The gear shaft 1342, which extends outside casing 1320, can be coupled to motor shaft 1342' via, e.g., a coupling 1385 such as a shaft hub to form a shaft extending from point 1384 to point 1386. One or more seals 1393 can be disposed to provide necessary sealing of the fluid. Design of the shafts 1342, 1342' and the means to couple the motor 1341 to gear 1350 can be varied without departing from the spirit of the present invention. It should be understood that those skilled in the art will recognize that fluid driver 1340 is similar to fluid driver 1260 and that the configurations and functions of fluid driver 1260, as discussed above, can be incorporated into fluid driver 1340. Accordingly, for brevity, fluid driver 1340 will not be discussed in detail except as necessary to describe this embodiment.

In addition, the gear 1350 and motor 1341 can be positioned side-by-side, on top of each other, or offset from each other. Thus, the present disclosure covers all of the above-discussed positional relationships and any other variations of a relatively proximate positional relationship between a gear and a motor outside the casing 1320. Also, in some exemplary embodiments, motor 1341 can be an outer-rotor motor design that are appropriately configured to rotate the gear 1350. Further, the means for transmitting torque (or power) from a motor to a gear is not limited to shafts. Instead, any combination of power transmission devices, e.g., shafts, sub-shafts, belts, chains, couplings, gears, connection rods, cams, or other power transmission devices, can be used without departing from the spirit of the present disclosure. In addition, the motor housing 1387 can include a vibration isolator (not shown) between the casing 1320 and the motor housing 1387. Further, the motor housing 1387 mounting is not limited to that illustrated in FIG. 7 and the motor housing can be mounted at any appropriate location on the casing 1320 or can even be separate from the casing 1320.

The fluid driver 1360 includes a motor 1361 and a gear 1370. The fluid driver 1360 is disposed next to fluid driver 1340 such that the respective gear teeth 1372, 1352 contact each other in a manner similar to the contact of gear teeth 52, 72 in contact area 128 discussed above with respect to pump 10. In this embodiment, motor 1361 is an inner-rotor motor design and is disposed in the motor cavity 1384. In this embodiment, the motor 1361 and the gear 1370 have a common shaft 1362. The rotor 1364 of motor 1361 is disposed radially between the shaft 1362 and the stator 1366. The stator 1366 is disposed radially outward of the rotor 1364 and surrounds the rotor 1364. Bearing 1395 can be disposed between motor 1361 and gear 1370. The bearing 1395 is similar in design and function to bearing 1095 discussed above. The inner-rotor design means that the shaft 1362, which is connected to rotor 1364, rotates while the stator 1366 is fixedly connected to the casing 1320. In addition, gear 1370 is also connected to the shaft 1362. It should be understood that those skilled in the art will recognize that the fluid driver 1360 is similar to fluid driver 1060 and that the configurations and functions of fluid driver 1060, as discussed above, can be incorporated into fluid driver 1360. Accordingly, for brevity, fluid driver 1360 will not be discussed in detail except as necessary to describe this embodiment. Also, in some exemplary embodiments, motor 1361 can be an outer-rotor motor design that is appropriately configured to rotate the gear 1370. In addition, it should be understood that those skilled in the art will recognize that the operation of pump 1310, including fluid drivers 1340, 1360, will be similar to that of pump 10 and thus, for brevity, will not be further discussed. In addition, the means for transmitting torque (or power) from the motor to the gear is not limited to a shaft. Instead, any combination of power transmission devices, for example, shafts, sub-shafts, belts, chains, couplings, gears, connection rods, cams, or other power transmission devices can be used without departing from the spirit of the present disclosure.

Figure 8:
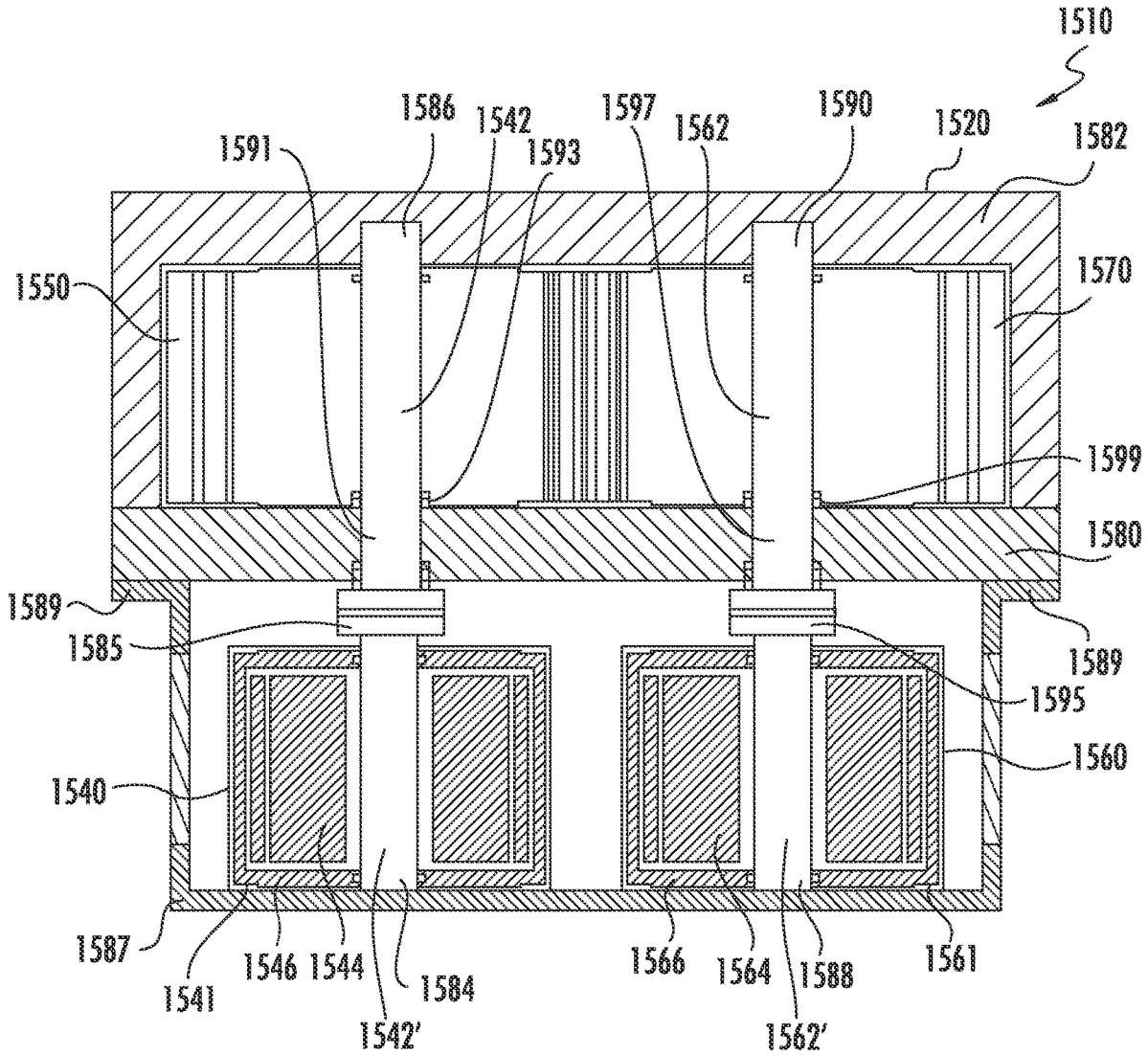

FIG. 8 shows a side cross-sectional view of another exemplary embodiment of an external gear pump 1510. The embodiment of the pump 1510 shown in FIG. 8 differs from pump 10 in that both motors are disposed outside a pump casing. The pump 1510 includes a casing 1520, a fluid driver 1540, and a fluid driver 1560. The inner surface of the casing 1520 defines an internal volume. The casing 1520 can include end plates 1580, 1582. These two plates 1580, 1582 can be connected to a body of the casing 1520 by a plurality of bolts.

The fluid drivers 1540, 1560 respectively include motors 1541, 1561 and gears 1550, 1570. The fluid driver 1540 is disposed next to fluid driver 1560 such that the respective gear teeth 1552, 1572 contact each other in a manner similar to the contact of gear teeth 52, 72 in contact area 78 discussed above with respect to pump 10. In this embodiment, motors 1541, 1561 are of an inner-rotor motor design and, as seen in FIG. 8, the motors 1541, 1561 are disposed outside the casing 1520. Each of the rotors 1544, 1564 of motors 1541, 1561 are disposed radially between the respective motor shafts 1542', 1562' and the stators 1546, 1566. The stators 1546, 1566 are disposed radially outward of the respective rotors 1544, 1564 and surround the rotors 1544, 1564. The inner-rotor designs mean that the shafts 1542', 1562', which are respectively coupled to rotors 1544, 1564, rotate while the stators 1546, 1566 are fixedly connected to the pump casing 1220 either directly or indirectly via, e.g., motor housing 1587. The gears 1550, 1570 respectively include shafts 1542, 1562 that can be supported by the plate 1582 at ends 1586, 1590 and the plate 1580 at ends 1591, 1597. The gear shafts 1542, 1562, which extend outside casing 1520, can be respectively coupled to motor shafts 1542', 1562' via, e.g., couplings 1585, 1595 such as shaft hubs to respectively form shafts extending from points 1591, 1590 to points 1584, 1588. One or more seals 1593 can be disposed to provide necessary sealing of the fluid. Design of the shafts 1542, 1542', 1562, 1562' and the means to couple the motors 1541, 1561 to respective gears 1550, 1570 can be varied without departing from the spirit of the present disclosure. It should be understood that those skilled in the art will recognize that the fluid drivers 1540, 1560 are similar to fluid driver 1260 and that the configurations and functions of fluid driver 1260, as discussed above, can be incorporated into fluid drivers 1540, 1560. Accordingly, for brevity, fluid drivers 1540, 1560 will not be discussed in detail except as necessary to describe this embodiment. In addition, it should be understood that those skilled in the art will also recognize that the operation of pump 1510, including fluid drivers 1540, 1560, will be similar to that of pump 10 and thus, for brevity, will not be further discussed. In addition, the means for transmitting torque (or power) from the motor to the gear is not limited to a shaft. Instead, any combination of power transmission devices, for example, shafts, sub-shafts, belts, chains, couplings, gears, connection rods, cams, or other power transmission devices can be used without departing from the spirit of the present disclosure. Also, in some exemplary embodiments, motors 1541, 1561 can be of an outer rotor motor design that are appropriately configured to respectively rotate the gears 1550, 1570.

In an exemplary embodiment, the motor housing 1587 can include a vibration isolator (not shown) between the plate 1580 and the motor housing 1587. In the exemplary embodiment above, the motor 1541 and the motor 1561 are disposed in the same motor housing 1587. However, in other embodiments, the motor 1541 and the motor 1561 can be disposed in separate housings. Further, the motor housing 1587 mounting and motor locations are not limited to that illustrated in FIG. 8, and the motors and motor housing or housings can be mounted at any appropriate location on the casing 1520 or can even be separate from the casing 1520.

Although the above embodiments were described with respect to an external gear pump design with spur gears having gear teeth, it should be understood that those skilled in the art will readily recognize that the concepts, functions, and features described below can be readily adapted to external gear pumps with other gear designs (helical gears, herringbone gears, or other gear teeth designs that can be adapted to drive fluid), internal gear pumps with various gear designs, to pumps having more than two prime movers, to prime movers other than electric motors, e.g., hydraulic motors or other fluid-driven motors, inter-combustion, gas or other type of engines or other similar devices that can drive a fluid displacement member, and to fluid displacement members other than an external gear with gear teeth, e.g., internal gear with gear teeth, a hub (e.g. a disk, cylinder, other similar component) with projections (e.g. bumps, extensions, bulges, protrusions, other similar structures or combinations thereof), a hub (e.g. a disk, cylinder, or other similar component) with indents (e.g., cavities, depressions, voids or other similar structures), a gear body with lobes, or other similar structures that can displace fluid when driven. Accordingly, for brevity, detailed description of the various pump designs are omitted. In addition, those skilled in the art will recognize that, depending on the type of pump, the synchronizing contact can aid in the pumping of the fluid instead of or in addition to sealing a reverse flow path. For example, in certain internal-gear gerotor designs, the synchronized contact between the two fluid drivers also aids in pumping the fluid, which is trapped between teeth of opposing gears. Further, while the above embodiments have fluid displacement members with an external gear design, those skilled in the art will recognize that, depending on the type of fluid displacement member, the synchronized contact is not limited to a side-face to side-face contact and can be between any surface of at least one projection (e.g. bump, extension, bulge, protrusion, other similar structure, or combinations thereof) on one fluid displacement member and any surface of at least one projection(e.g. bump, extension, bulge, protrusion, other similar structure, or combinations thereof) or indent (e.g., cavity, depression, void or other similar structure) on another fluid displacement member. Further, while two prime movers are used to independently and respectively drive two fluid displacement members in the above embodiments, it should be understood that those skilled in the art will recognize that some advantages (e.g., reduced contamination as compared to the driver-driven configuration) of the above-described embodiments can be achieved by using a single prime mover to independently drive two fluid displacement members. In some embodiments, a single prime mover can independently drive the two fluid displacement members by the use of, e.g., timing gears, timing chains, or any device or combination of devices that independently drives two fluid displacement members while maintaining synchronization with respect to each other during operation.

The fluid displacement members, e.g., gears in the above embodiments, can be made entirely of any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. Metallic material can be used for a pump that requires robustness to endure high pressure, for example. However, for a pump to be used in a low pressure application, non-metallic material can be used. In some embodiments, the fluid displacement members can be made of a resilient material, e.g., rubber, elastomeric material, etc., to, for example, further enhance the sealing area.

Alternatively, the fluid displacement member, e.g., gears in the above embodiments, can be made of a combination of different materials. For example, the body can be made of aluminum and the portion that makes contact with another fluid displacement member, e.g., gear teeth in the above exemplary embodiments, can be made of steel for a pump that requires robustness to endure high pressure, a plastic for a pump for a low pressure application, a elastomeric material, or another appropriate material based on the type of application.

Pumps consistent with the above exemplary embodiments can pump a variety of fluids. The working fluid (or fluid) to be pumped by the external gear pump 10 can be either high viscosity liquid (e.g. engine oil) or low viscosity liquid (e.g. water). Here, high viscosity means a viscosity higher than 1 mPa·s at 25° C. and low viscosity means a viscosity equal to or lower than 1 mPa·s at 25° C. For example, the pumps can be designed to pump hydraulic fluid, engine oil, crude oil, blood, liquid medicine (syrup), paints, inks, resins, adhesives, molten thermoplastics, bitumen, pitch, molasses, molten chocolate, water, acetone, benzene, methanol, or another fluid. As seen by the type of fluid that can be pumped, exemplary embodiments of the pump can be used in a variety of applications such as heavy and industrial machines, chemical industry, food industry, medical industry, commercial applications, residential applications, or another industry that uses pumps. Factors such as viscosity of the fluid, desired pressures and flow for the application, the design of the fluid displacement member, the size and power of the motors, physical space considerations, weight of the pump, or other factors that affect pump design will play a role in the pump design. It is contemplated that, depending on the type of application, pumps consistent with the embodiments discussed above can have operating ranges that fall with a general range of, e.g., 1 to 5000 rpm. Of course, this range is not limiting and other ranges are possible.

The pump operating speed can be determined by taking into account factors such as viscosity of the fluid, the prime mover capacity (e.g., capacity of electric motor, hydraulic motor or other fluid-driven motor, internal-combustion, gas or other type of engine or other similar device that can drive a fluid displacement member), fluid displacement member dimensions (e.g., dimensions of the gear, hub with projections, hub with indents, or other similar structures that can displace fluid when driven), desired flow rate, desired operating pressure, and pump bearing load. In exemplary embodiments, for example, applications directed to typical industrial hydraulic system applications, the operating speed of the pump can be, e.g., in a range of 300 rpm to 900 rpm. In addition, the operating range can also be selected depending on the intended purpose of the pump. For example, in the above hydraulic pump example, a pump designed to operate within a range of 1-300 rpm can be selected as a stand-by pump that provides supplemental flow as needed in the hydraulic system. A pump designed to operate in a range of 300-600 rpm can be selected for continuous operation in the hydraulic system, while a pump designed to operate in a range of 600-900 rpm can be selected for peak flow operation. Of course, a single, general pump can be designed to provide all three types of operation.

In addition, the dimensions of the fluid displacement members can vary depending on the application of the pump. For example, when gears are used as the fluid displacement members, the circular pitch of the gears can range from less than 1 mm (e.g., a nano-composite material of nylon) to a few meters wide in industrial applications. The thickness of the gears will depend on the desired pressures and flows for the application.

In some embodiments, the speed of the prime mover, e.g., a motor, that rotates the fluid displacement members, e.g., a pair of gears, can varied to control the flow from the pump. In addition, in some embodiments the torque of the prime mover, e.g., motor, can be varied to control the output pressure of the pump.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A pump comprising:

a pump casing defining an interior volume, the pump casing including a first port in fluid communication with the interior volume, and a second port in fluid communication with the interior volume;

a first gear disposed within the interior volume, the first gear having a first gear body and a plurality of first gear teeth;

a second gear disposed within the interior volume, the second gear having a second gear body and a plurality of second gear teeth projecting radially outwardly from the second gear body, the second gear is disposed such that a second face of at least one tooth of the plurality of second gear teeth aligns with a first face of at least one tooth of the plurality of first gear teeth;

a first motor that rotates the first gear about a first axial centerline of the first gear in a first direction to transfer a fluid from the first port to the second port along a first flow path; and a second motor that rotates the second gear, independently of the first motor, about a second axial centerline of the second gear in a second direction to provide synchronized contact between the second face and the first face and to transfer the fluid from the first port to the second port along a second flow path, wherein the first motor includes a first motor casing, wherein the first gear body includes a first opening along the first axial centerline that is configured to accept the first motor, including the first motor casing, wherein the first motor is an outer-rotor motor and is disposed in the first opening, the first motor comprising a first rotor, wherein the first rotor is coupled to the first gear via the first motor casing to rotate the first gear about the first axial centerline in the first direction, wherein the second motor includes a second motor casing, wherein the second gear body includes a second opening along the second axial centerline that is configured to accept the second motor, including the second motor casing, and wherein the second motor is an outer-rotor motor and is disposed in the second opening, the second motor comprising a second rotor, and wherein the second rotor is coupled to the second gear via the second motor casing to rotate the second gear about the second axial centerline in the second direction.

2. The pump of claim 1, wherein the fluid the pump is configured to transfer is a hydraulic fluid.

3. The pump of claim 1, wherein the fluid the pump is configured to transfer is water.

4. The pump of claim 1, wherein the pump is configured to operate in a range of 1 rpm to 5000 rpm.

5. The pump of claim 1, wherein the first motor and the second motor are bi-directional.

6. The pump of claim 1, wherein the first motor and the second motor are variable speed motors.

7. The pump of claim 1, wherein a slip coefficient of the pump is 5% or less for pump pressures in a range of 3000 psi to 5000 psi, 3% or less for pump pressures in a range of 2000 psi to 3000 psi, 2% or less for pump pressures in a range of 1000 psi to 2000 psi, and 1% or less for pump pressures in a range up to 1000 psi.

8. The pump of claim 1, wherein the pump has a gerotor design.

9. The pump of claim 1, wherein the first and second motor casings are coupled to respective inner surfaces of the first and second openings, and wherein each coupling between the first and second motor casings and the respective inner surfaces is via a support member.

10. The pump of claim 9, wherein the coupling is achieved using at least one of an interference fit, a press fit, screws, bolts, an adhesive, a welding or soldering method between the support member and the respective first and second motor casing or between the support member and the respective inner surface.

11. The pump of claim 10, wherein the support member is configured as a sacrificial component that fails first in comparison to the first and second gears or in comparison to the first and second motors.

12. A method of assembling a pump having a pump casing that defines an interior volume therein, the pump further including a first motor having a first casing, a second motor having a second casing, a first gear having a plurality of first gear teeth, and a second gear having a plurality of second gear teeth, the method comprising:

providing a first opening that is configured to accept the first motor, including the first motor casing, along the first axial centerline in a gear body of the first gear;

disposing the first motor, including the first motor casing, within the first opening;

coupling a first rotor of the first motor to the first gear;

providing a second opening that is configured to accept the second motor, including the second motor casing, along the second axial centerline in a gear body of the second gear;

disposing the second motor, including the second motor casing, within the second opening;

coupling a second rotor of the second motor to the second gear, wherein the first motor is an outer-rotor motor, and wherein the second motor is an outer-rotor motor.

13. The method of claim 12, further comprising:

coupling the first and second motor casings to respective inner surfaces of the first and second openings, wherein each coupling between the first and second motor casings and the respective inner surfaces is via a support member.

14. The method of claim 13, wherein the coupling is achieved using at least one of an interference fit, a press fit, screws, bolts, an adhesive, a welding or soldering method between the support member and the respective first and second motor casing or between the support member and the respective inner surface.

15. The pump of claim 14, wherein the support member is configured as a sacrificial component that fails first in comparison to the first and second gears or in comparison to the first and second motors.

16. A method of transferring fluid from a first port to a second port of a pump including a pump casing that defines an interior volume therein, the pump further including a first motor having a first casing, a second motor having a second casing, a first gear having a plurality of first gear teeth, and a second gear having a plurality of second gear teeth, the method comprising:

rotating the first motor to rotate the first gear about a first axial centerline of the first gear in a first direction to transfer a fluid from the first port to the second port along a first flow path;

rotating the second motor, independently of the first motor, to rotate the second gear about a second axial centerline of the second gear in a second direction to transfer the fluid from the first port to the second port along a second flow path; and synchronizing contact between a face of at least one tooth of the plurality of second gear teeth and a face of at least one tooth of the plurality of first gear teeth, wherein the first motor, including the first motor casing, is disposed within a first opening in the first gear, and wherein the second motor, including the second motor casing, is disposed within a second opening in the second gear.

17. The method of claim 16, further comprising:

pumping a hydraulic fluid.

18. The method of claim 16, further comprising:

pumping water.

19. The method of claim 16, wherein the first motor and the second motor are variable speed.

20. The method of claim 16, further comprising:

synchronizing the first and second gears such that a slip coefficient is 5% or less for pump pressures in a range of 3000 psi to 5000 psi, 3% or less for pump pressures in a range of 2000 psi to 3000 psi, 2% or less for pump pressures in a range of 1000 psi to 2000 psi, and 1% or less for pump pressures in a range up to 1000 psi.

* * * * *